US012478826B2

(12) United States Patent
Taxak et al.

(10) Patent No.: US 12,478,826 B2
(45) Date of Patent: Nov. 25, 2025

(54) METHODS FOR A MULTI-CONFIGURATION EXERCISE DEVICE

(71) Applicant: Freak Athlete Essentials LLC, Casper, WY (US)

(72) Inventors: Yogesh Taxak, West Bloomfield, MI (US); Benjamin Alfred Elster, Walnut Creek, CA (US); Liang Han Wu, Fujian (CN)

(73) Assignee: Freak Athlete Essentials LLC, Casper, WY (US)

( * ) Notice: Subject to any disclaimer, the term of this patent is extended or adjusted under 35 U.S.C. 154(b) by 0 days.

(21) Appl. No.: 19/045,113

(22) Filed: Feb. 4, 2025

(65) Prior Publication Data

US 2025/0186827 A1 Jun. 12, 2025

Related U.S. Application Data

(63) Continuation of application No. 18/430,353, filed on Feb. 1, 2024, now Pat. No. 12,257,474, which is a (Continued)

(30) Foreign Application Priority Data

Dec. 8, 2023 (CN) ..... 202323354501.3

(51) Int. Cl.
*A63B 21/00* (2006.01)

(52) U.S. Cl.
CPC ..... *A63B 21/4029* (2015.10)

(58) Field of Classification Search
CPC ..... A63B 21/4029; A63B 2208/0247; A63B 2208/0285; A63B 23/0211
See application file for complete search history.

(56) References Cited

U.S. PATENT DOCUMENTS 4,358,109 A * 11/1982 Schrems ..... A63B 21/00047 482/142
4,863,161 A 9/1989 Telle
(Continued)

FOREIGN PATENT DOCUMENTS

GB 2367764 A 4/2002
WO 2021252997 A1 12/2021

OTHER PUBLICATIONS

"Freak Athlete Nordic Hyper GHD—The Review You've Been Waiting For," published Nov. 21, 2023. https://www.youtube.com/watch?v=R5bkn7Ef844.
(Continued)

*Primary Examiner* — Andrew M Kobylarz
(74) *Attorney, Agent, or Firm* — Aurora Consulting LLC; Albert Du; Ashley Sloat

(57) ABSTRACT

A method of adjusting a length of a first strut coupled to a support beam and an interface frame to adjust a first angle between the interface frame and the support beam. A method of adjusting a second angle between the support beam and the base frame with at least one of: an auxiliary support beam coupled to the support beam or the base frame, or a second strut with an adjustable length coupled to the support beam and the base frame. The second angle is adjusted to be less than the first angle such that the interface frame and the base frame define a decline angle. Adjusting the first angle and the second angle manipulates a height and an orientation of the interface frame with respect to the base frame.

20 Claims, 23 Drawing Sheets

Related U.S. Application Data continuation of application No. PCT/US2024/011560, filed on Jan. 15, 2024.

(60) Provisional application No. 63/607,687, filed on Dec. 8, 2023.

(56) References Cited

U.S. PATENT DOCUMENTS

| | | | | |
|---|---|---|---|---|
| 5,125,884 | A | 6/1992 | Weber et al. | |
| 5,549,533 | A | 8/1996 | Olson et al. | |
| 5,643,147 | A * | 7/1997 | Huang | A63B 21/068 482/96 |
| 6,001,051 | A | 12/1999 | Chuan-Pin | |
| 6,093,135 | A * | 7/2000 | Huang | A63B 21/068 482/142 |
| 9,211,431 | B2 | 12/2015 | Hornback et al. | |
| 10,974,096 | B2 | 4/2021 | Simmons | |
| D990,589 | S * | 6/2023 | Bo | D21/676 |
| 11,904,198 | B1 | 2/2024 | Romano et al. | |
| 2003/0004036 | A1 | 1/2003 | Yoss | |
| 2004/0067829 | A1 | 4/2004 | Eschenbach | |
| 2006/0217249 | A1 | 9/2006 | Webber | |
| 2012/0295780 | A1 | 11/2012 | Chou | |
| 2014/0066276 | A1 | 3/2014 | Hornback et al. | |
| 2015/0011370 | A1 | 1/2015 | Henniger | |
| 2015/0367168 | A1 | 12/2015 | Henniger et al. | |
| 2017/0028246 | A1 | 2/2017 | Vorozilchak et al. | |
| 2019/0105527 | A1 | 4/2019 | Hallmark | |
| 2023/0111117 | A1 * | 4/2023 | Kordecki | A63B 22/0023 482/8 |
| 2023/0191188 | A1 | 6/2023 | Schneer | |
| 2024/0066350 | A1 | 2/2024 | Hibberts et al. | |

OTHER PUBLICATIONS

"Introducing The Nord-Ex", Shogun Sports, Printed Feb. 2024, https://shogunsports.com/products/mr1nf1n1ty-x-shogun-nordex?gclid=Cj0KCQjwhL6pBhDjARIsAGx8D5_S1KtLeYihGwrPSXn2EewtRBMdpQTIMzs4XO61x5kKVT19K5hnydMaAunwEALw_wcB.

"The Nordic Back Extension Machine", The Tib Bar Guy, Printed Feb. 2024, https://thetibbarguy.com/products/the-nordic-back-extension-machine?tw_source=google&tw_adid=654729031418&tw_campaign=19966743319&gad_source=1&gclid=CjwKCAiA_OetBhAtEiwAPTeQZ8utwF0SY bliYJ3qzK-FkRMjQzGptCIUZQcAkwqVKEY9TyPhAqaLWhoCKyoQAvD_BWE.

"The Nordic Plus", Base Blocks, Printed Feb. 2024, https://www.baseblocks.fit/pages/the-nordic-plus.

"Thruster Lite", BC Strength, Printed Feb. 2024, https://www.bcstrength.com/collections/hip-thrust/products/thruster-lite.

European Search Report re EP 24718693.5-1122 dated Oct. 23, 2024 (4 pages).

Gymleco Back Raise, Adjustable 45-90 degrees, https://www.gymleco.com/product/back-raise-adjustable-45-90-degrees/, printed Mar. 13, 2024 12:08pm (5 pages).

International Search Report re PCT/US2024/011560 mailed Apr. 3, 2024 (2 pages).

Nordic Hyper GHD Bench—Freak Athlete printed Mar. 25, 2024, 1:37PM, hltps://web.archive.org/web/20231102192404/hltps://freakalhlete.co/products/nordic-hyper-ghd (23 pages).

TuffStuff Fitness, Evolution Adjustable Hyper-Extension Bench, https://www.tuffstuffi tness.com/product/evolution-hyper-extension-bench/, printed Mar. 13, 2024 12:10PM (13 pages).

Written Opinion re PCT/US2024/011560 mailed Apr. 3, 2024 (12 pages).

* cited by examiner

METHODS FOR A MULTI-CONFIGURATION EXERCISE DEVICE

CROSS-REFERENCE TO RELATED APPLICATIONS

This application is a continuation of U.S. Utility patent application Ser. No. 18/430,353, filed on Feb. 1, 2024; which claims priority to International PCT application PCT/US24/11560, filed on Jan. 15, 2024; which claims the priority benefit of Chinese Utility Model No. 202323354501.3, filed Dec. 8, 2023, and U.S. Provisional Application No. 63/607,687, filed Dec. 8, 2023, the contents of each of which are herein incorporated by reference in their entirety.

TECHNICAL FIELD

This disclosure relates generally to the field of exercise devices and methods, and more specifically to the field of multi-configuration exercise devices.

BACKGROUND

There exists a long-known issue of requiring a multitude of exercise machines to fulfill various exercise routines. Requiring a multitude of exercise machines involves inconvenience, space constraints, and financial burden issues placed on individuals. Many people desire a diverse workout regimen to target different muscle groups and achieve well-rounded fitness. However, accommodating a range of machines for strength training, flexibility, and specialized exercises can quickly clutter one's home or gym space. Furthermore, owning multiple machines can be expensive, not to mention the maintenance costs and regular upgrades that may be required. The fragmentation created in exercise equipment can also deter some from staying committed to their fitness journey, as the logistical challenges and costs associated with acquiring and maintaining various machines can make consistent exercise more challenging.

SUMMARY

In some aspects, the techniques described herein relate to a method of adjusting a multi-configuration exercise device, including: adjusting a length of a first strut coupled to a support beam and an interface frame to adjust a first angle between the interface frame and the support beam; and adjusting a second angle between the support beam and the base frame with at least one of: an auxiliary support beam coupled to the support beam or the base frame, or a second strut with an adjustable length coupled to the support beam and the base frame, wherein the second angle is adjusted to be less than the first angle such that the interface frame and the base frame define a decline angle, and wherein adjusting the first angle and the second angle manipulates a height and an orientation of the interface frame with respect to the base frame.

In some aspects, the techniques described herein relate to a method of adjusting a multi-configuration exercise device, including: adjusting a length of a first strut coupled to a support beam and an interface frame to adjust a first angle between the interface frame and the support beam; and adjusting a length of a second strut coupled to the support beam and a base frame to adjust a second angle between the support beam and the base frame, wherein the second angle is adjusted to be less than the first angle such that the interface frame and the base frame define a decline angle, and wherein adjusting the first angle and the second angle is configured to manipulate a height and an orientation of the interface frame with respect to the base frame.

In some aspects, the techniques described herein relate to a method of adjusting a multi-configuration exercise device, including: adjusting a length of a first strut coupled to a support beam and an interface frame to adjust a first angle between the interface frame and the support beam; and adjusting a length of a second strut coupled to the support beam and a base frame to adjust a second angle between the support beam and the base frame, wherein adjusting the first angle and the second angle manipulates a height and an orientation of the interface frame with respect to the base frame.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the claimed subject matter. Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

Multi-configuration exercise devices described herein include an interface frame operatively coupled to a base frame. Multi-configuration exercise devices contemplated herein include a variety of interface frame heights and orientations, with respect to the base frame. Additionally, devices described herein may include a multitude of configurations achieved by removing one or more pads or coupling one or more pads to the interface frame and/or the base frame. The various configurations of interface frame heights and orientations, with respect to the base frame, have been contemplated to be combined with any pad configuration. The contemplated configurations are intended for a multitude of exercises.

In some embodiments, the exercise devices described herein are configured to save floor space in a gym facility, home gym, living room, office, etc. where the exercise device may be used, while also providing a user with a plurality of configurations to perform various exercises on or using the exercise device. For example, the exercise device, in some configurations, may consume about 0.6 m to about 1.4 m area on a floor. In some configurations, the exercise device may consume about 0.6 m to about 0.6 m area on a floor. In some embodiments, the exercise device is transitionable between two configurations, more than two configurations, a plurality of configurations, three configurations, four configurations, five configurations, or six configurations. In some embodiments, any of the configurations may be used with or without one or more pads or a plurality of pads that are couplable to the interface frame.

Figure 1:
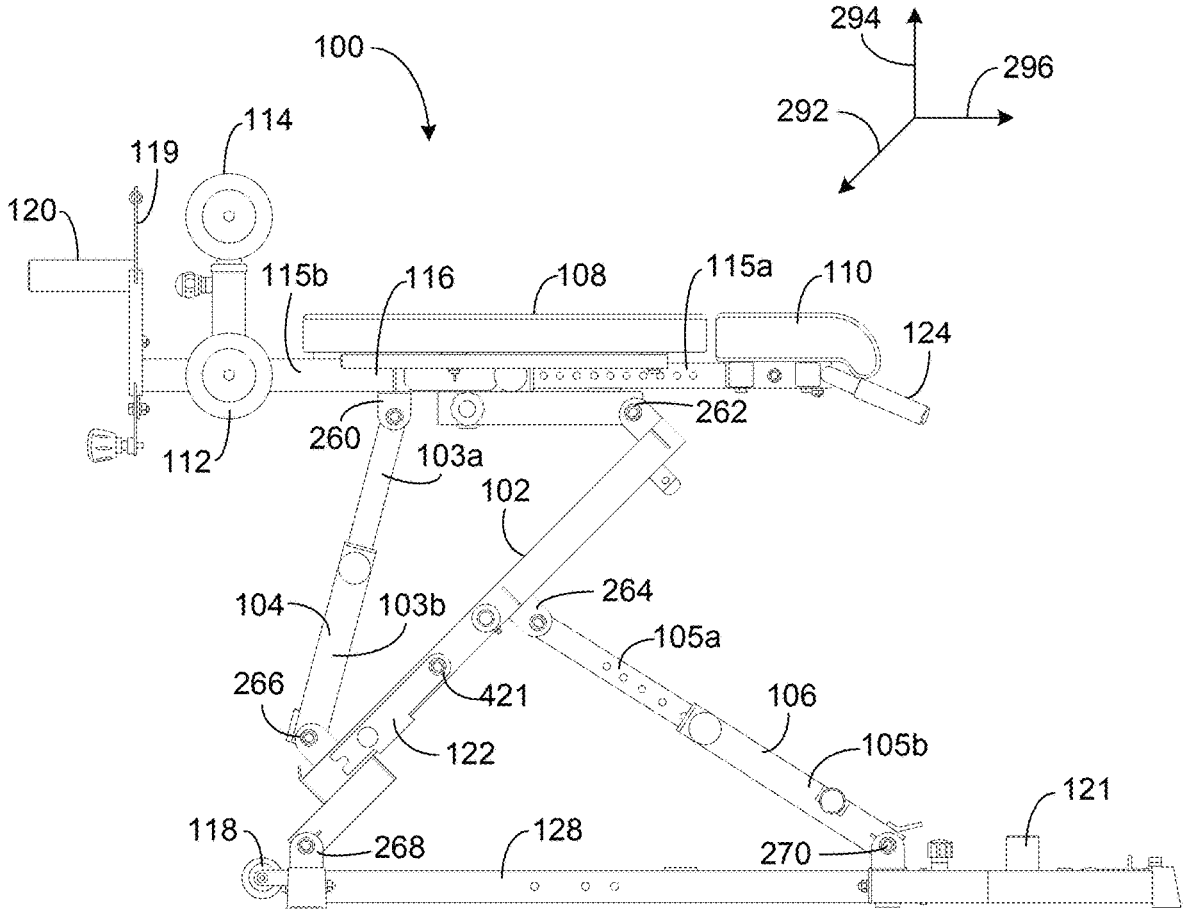
FIG. 1 illustrates an embodiment of a multi-configuration exercise device in an example configuration.
Figure 2:
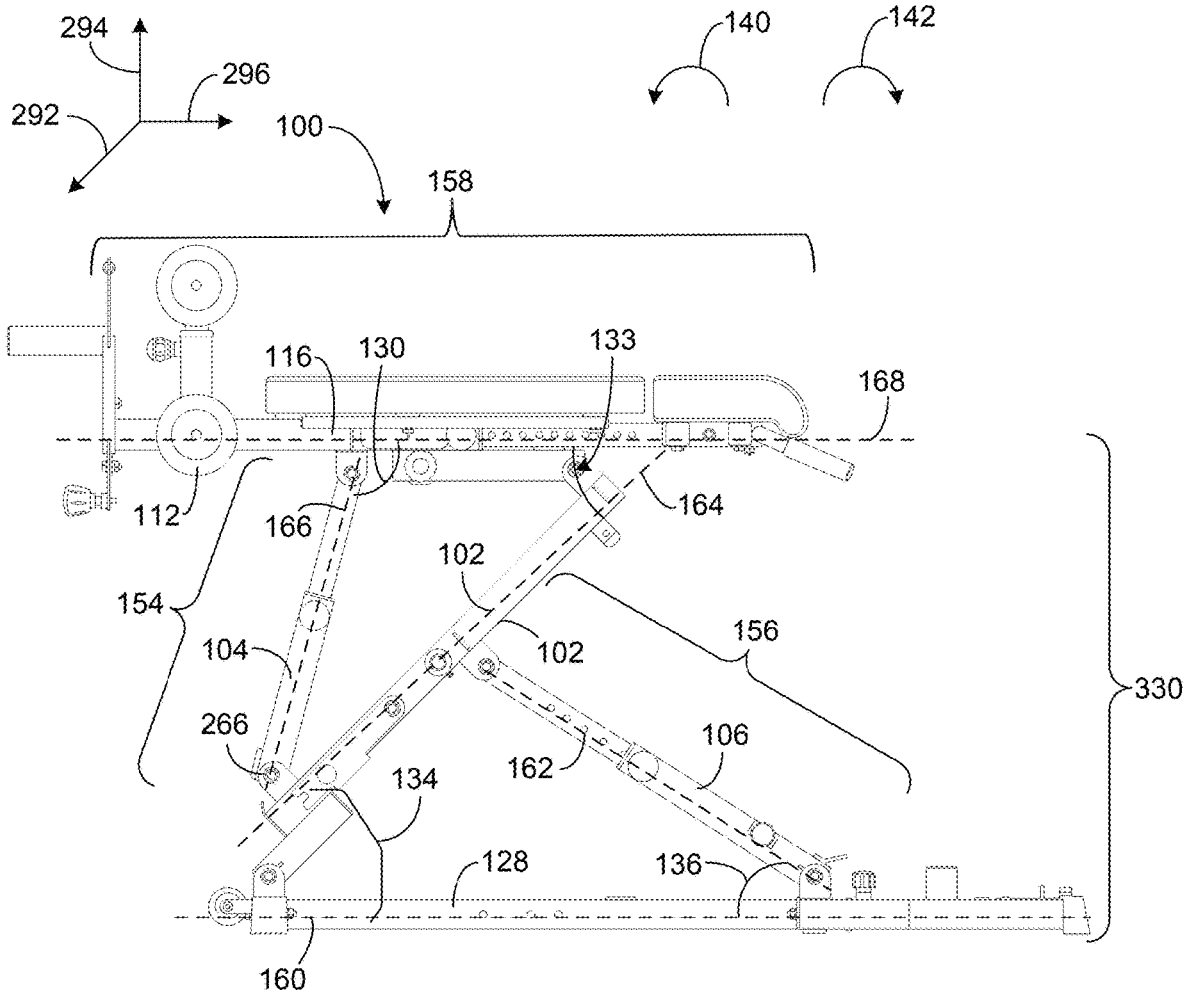
FIG. 2 illustrates an embodiment of a multi-configuration exercise device in an expanded configuration with angle relationships illustrated.

FIGS. 1-2 illustrate an embodiment of a multi-configuration exercise device 100 in an example configuration. The configuration shown in FIG. 1 may be used, for example, by a user to perform abdominal exercises (e.g., sit-ups), hamstring exercises (e.g., glute-ham development), and/or lower back exercises (e.g., 90-degree back extensions). The device 100 includes a base frame 128 and an interface frame 116 operatively coupled together. When the base frame 128 is laid upon a surface (e.g., the plane defined by the horizontal axis 296 and the normal axis 292), such that the longitudinal axis 160 of the base frame 128 is approximately parallel to the surface, and with gravity acting approximately normal to the surface, the base frame 128 rigidly supports and stabilizes the device 100. The base frame 128 may be operatively coupled to the interface frame 116 via a support beam 102. Support beam 102 may be hingedly coupled to the base frame 128 via coupling 268, and the support beam 102 may be hingedly coupled to the interface frame 116 via coupling 262. The support beam 102 may be further coupled to the interface frame 116 via a first strut 104. The first strut 104 may be hingedly coupled to the support beam 102 via coupling 266, and the first strut 104 may be hingedly coupled to the interface frame 116 via coupling 260. The support beam 102 may be further coupled to the base frame 128 via a second strut 106. The second strut 106 may be hingedly coupled to the support beam 102 via coupling 264, and the second strut 106 may be hingedly coupled to the base frame 128 via coupling 270. Couplings 260, 262, 264, 266, 268, 270 may allow rotation adjustment in rotation directions 140 and 142 (shown in FIG. 2). The interface frame 116 may include a plurality of pads: pad 108, pad 110, pad 111 (shown in FIGS. 8 and 14A-16), cylindrical pad 114, and cylindrical pad 114. Additionally, the interface frame 116 may include a base plate 119 and one or more handles. The base frame 128 may include one or more wheels 118 and one or more weight pegs 121. The height 330 (shown in FIG. 2) and orientation of the interface frame 116 may be manipulated with respect to the base frame 128.

In some embodiments, the first strut 104 and the second strut 106 may include length adjustability. For example, as shown in FIG. 1, the first strut 104 may include a first portion 103*a* and a second portion 103*b*. In some embodiments, the first portion 103*a* may fit within the second portion 103*b* (e.g., the first portion 103*a* including a smaller outer diameter tube fitting within a larger inner diameter tube of a second portion 103*b*, the first portion 103*a* may telescope within the second portion 103*b*, etc.). The first strut 104 may be extendable and retractable by sliding the first portion 103*a* out of or into the second portion 103*b*, respectively. Further, for example, as shown in FIG. 1, the second strut 106 may include a first portion 105*a* and a second portion 105*b*. In some embodiments, the first portion 105*a* may fit within the second portion 105*b* (e.g., the first portion 105*a* including a smaller inner diameter tube fitting within a larger outer diameter tube of the second portion 105*b*, the first portion 105*a* may telescope within the second portion 105*b*, etc.). The second strut 106 may be extendable and retractable by sliding the first portion 105*a* out of or into the second portion 105*b*, respectively. As such, the height 330 and orientation of the interface frame 116 with respect to the base frame 128 may be manipulated by adjusting the length 154 of the first strut 104, the length 156 of the second strut 106, or a combination of the length 154 and length 156.

Figure 3B:
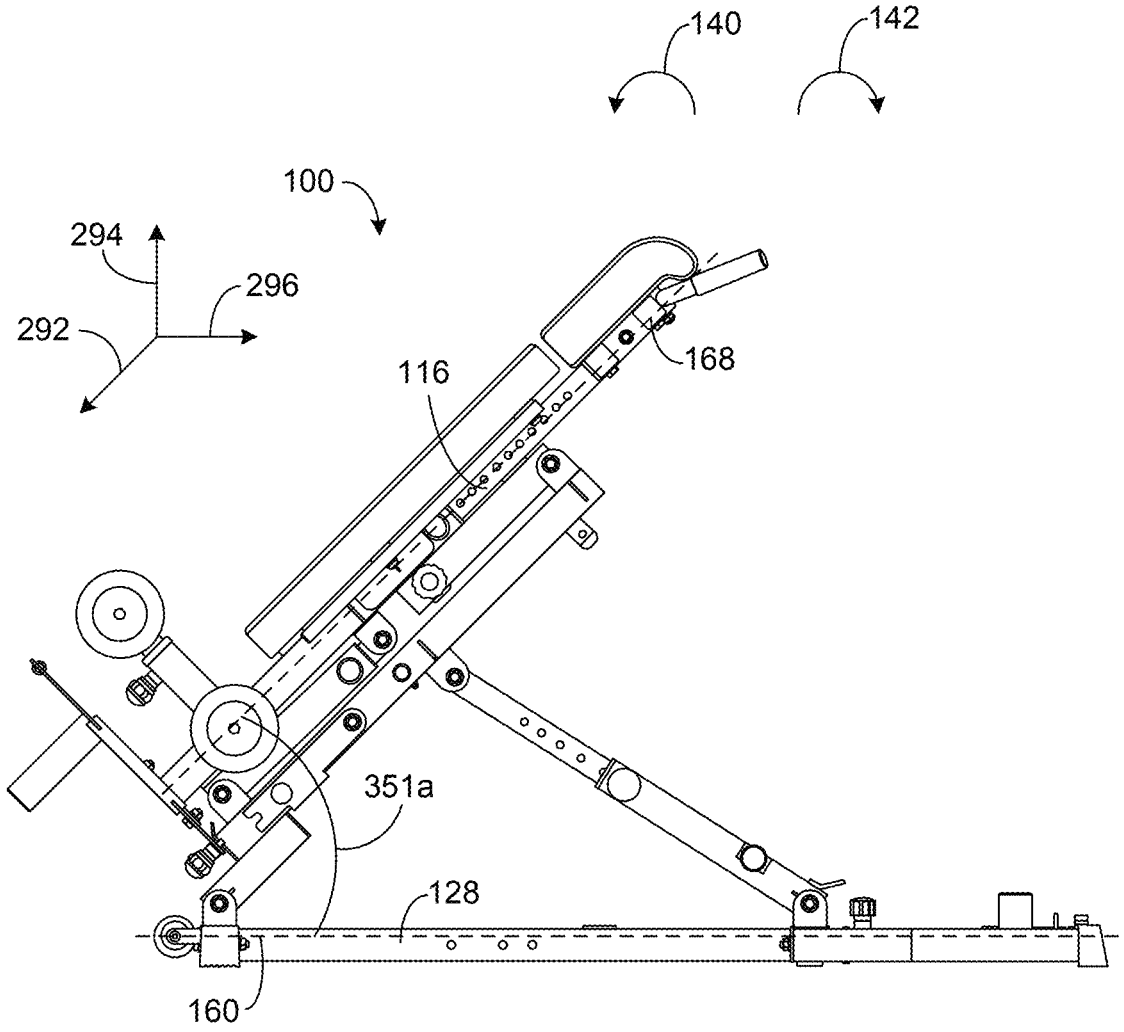
FIG. 3B illustrates an embodiment of a multi-configuration exercise device in an example configuration with an incline angle.
Figure 4A:
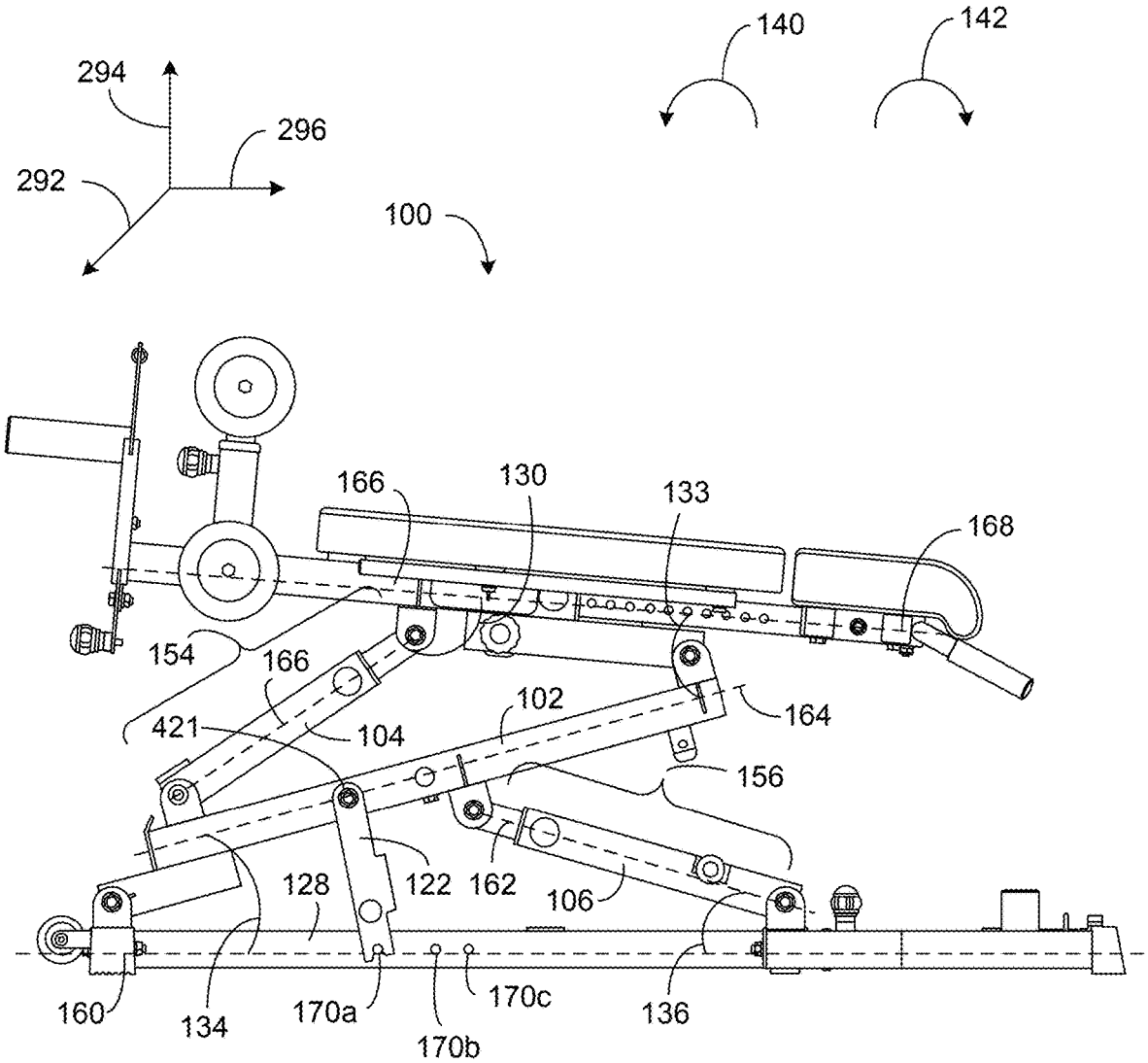
FIG. 4A illustrates an embodiment of a multi-configuration exercise device in an example configuration.
Figure 4B:
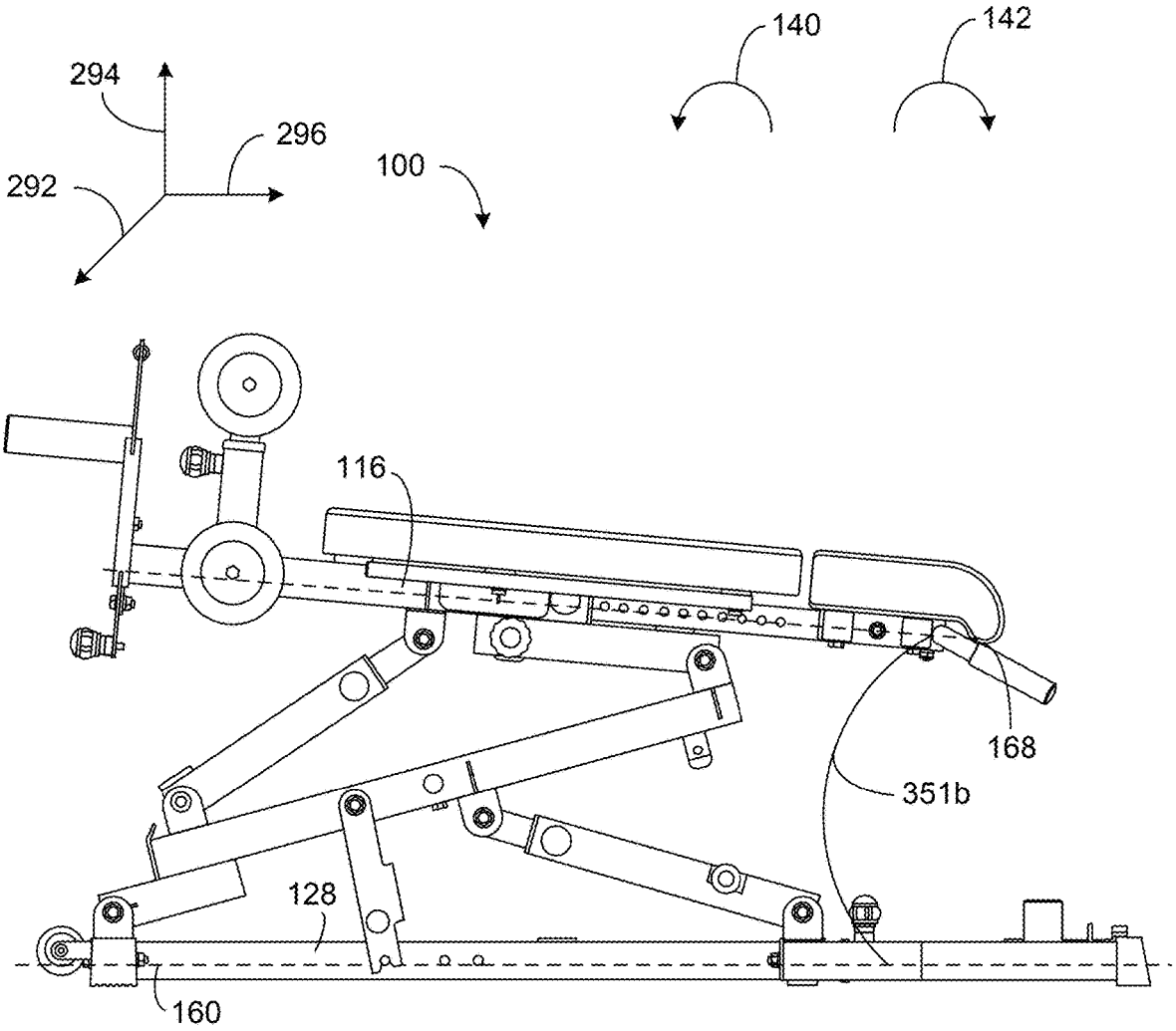
FIG. 4B illustrates an embodiment of a multi-configuration exercise device in an example configuration with a decline angle.

FIG. 2 illustrates the multi-configuration exercise device 100 in an expanded configuration. For example, the height 330 of the device 100 shown in FIG. 2 may be about 0.75 m to about 1.25 m; about 0.80 m to about 1.20 m; about 0.90 m to about 1.10 m; etc. Orientation of the interface frame 116 is with respect to the base frame 128, which may be described as angle 351 (shown in FIGS. 3B and 4B) between the longitudinal axis 168 of the interface frame 116 and the longitudinal axis 160 of the base frame 128, or the absence thereof (i.e., if the longitudinal axis 168 of the interface frame 116 is approximately parallel to the longitudinal axis 160 of the base frame 128). For example, as shown in FIG. 3B, the interface frame 116 may be rotated with respect to a plane defined by the horizontal axis 296 and the vertical axis 294 in rotation direction 140, such that incline angle 351*a* (interface frame 116 at an incline) is created. Incline angle 351*a* exist when the second angle 134 (shown in FIG. 2) is greater than the first angle 134 (shown in FIG. 2) and the degree value of incline angle 351*a* is the differential between second angle 134 and the first angle 133. For example, when the second angle 134 is about 45 degrees and the first angle 133 is about 20 degrees, the resulting incline angle 351*a* is about 25 degrees. Incline angle 351*a* may be greater than about 0 degrees (i.e., the longitudinal axis 168 of the interface frame 116 being approximately parallel to the longitudinal axis 160 of the base frame 128) to about 90 degrees; greater than about 0 degrees to about 60 degrees; greater than about 0 degrees to about 45 degrees; etc. Inversely, as shown in FIG. 4B, the interface frame 116 may be rotated with respect to a plane defined by the horizontal axis 296 and the vertical axis 294 in rotation direction 142, such that decline angle 351*b* is created. Decline angle 351*b* exist when the second angle 134 (shown in FIG. 2) is less than the first angle 134 (shown in FIG. 2) and the degree value of decline angle 351*b* is the differential between second angle 134 and the first angle 133. For example, when the second angle 134 is about 20 degrees and the first angle 133 is about 45 degrees, the resulting decline angle 351*b* is 25 degrees. Decline angle 351*b* may be greater than about 0 degrees (i.e., the longitudinal axis 168 of the interface frame 116 being approximately parallel to the longitudinal axis 160 of the base frame 128) to about 90 degrees; greater than about 0 degrees to about 60 degrees; greater than about 0 degrees to about 45 degrees; etc. If the length 154 of the first strut 104 is reduced, the third angle 130 between the first strut 104 and the interface frame 116 is increased, while the first angle 133 between the interface frame 116 and the support beam 102 is decreased. Inversely, if the length 154 of the first strut 104 is increased, the third angle 130 between the first strut 104 and the interface frame 116 is decreased, while the first angle 133 between the interface frame 116 and the support beam 102 is increased. If the length 156 of the second strut 106 is reduced, the fourth angle 136 between the second strut 106 and the base frame 128 is decreased, and the second angle 134 between the base frame 128 and the support beam 102 is decreased. Inversely, if the length 156 of the second strut 106 is increased, the fourth angle 136 between the second strut 106 and the base frame 128 is increased, and the second angle 134 between the base frame 128 and the support beam 102 is increased. Additionally, if the length 154 of the first strut 104 is reduced, the interface frame 116 can be pitched about the coupling 262 (shown in FIG. 1) in rotation direction 140. If the length 154 of the first strut 104 is increased, the interface frame 116 can be pitched with respect to a plane defined by the horizontal axis 296 and the vertical axis 294 about the coupling 262 (shown in FIG. 1) in rotation direction 142. Additionally, if the length 156 of the second strut 106 is reduced, the support beam 102 can be pitched about the coupling 268 (shown in FIG. 1) in rotation direction 142. If the length 156 of the second strut 106 is increased, the support beam 102 can be pitched about the coupling 268 (shown in FIG. 1) in rotation direction 140.

Figure 3A:
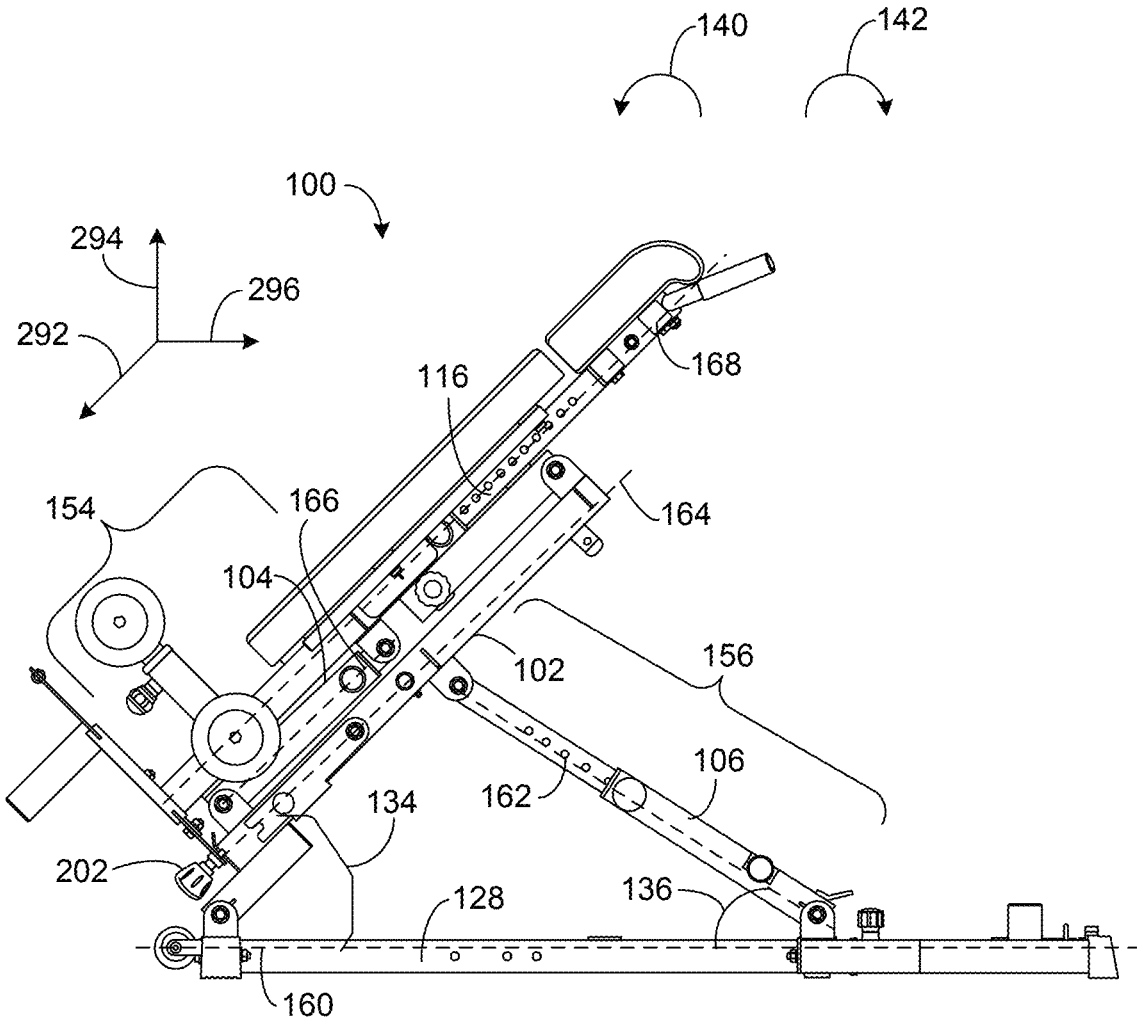
FIG. 3A illustrates an embodiment of a multi-configuration exercise device in an example configuration.

FIG. 3A illustrates an embodiment of a multi-configuration exercise device 100 in an example configuration. When adjusted in this manner, the device 100 may be used by a user to perform hamstring exercises (e.g., glute-ham development at reduced difficulty), and/or lower back exercises (e.g., 90-degree back extensions). The configuration shown in FIG. 3A includes the first strut 104 at a reduced length 154, such that the first angle 133 (shown in FIG. 2) is less than the second angle 134. When adjusted to the minimum length 154 as shown in FIG. 3A, the first strut 104 includes a longitudinal axis 166 that is approximately parallel to the longitudinal axis 168 of the interface frame 116. In addition, the longitudinal axis 166 of the first strut 104 and, thus, the longitudinal axis 168 of the interface frame 116 are approximately parallel to the longitudinal axis 164 of the support beam 102. The longitudinal axis 168 of the interface frame 116 may be manipulated with respect to the longitudinal axis 164 of the support beam 102, as described by first angle 133 (shown in FIG. 2), over a range of degrees, for example about 0 degrees (i.e., the longitudinal axis 168 of the interface frame 116 being approximately parallel to the longitudinal axis 164 of the support beam 102) to about 120 degrees; about 0 degrees to about 90 degrees; about 0 degrees to about 60 degrees; about 0 degrees to about 45 degrees; etc. The number of degrees achieved at first angle 133 is a function of the adjusted length 154 of the first strut 104. For example, with the first strut 104 at a minimum length 154 (as shown in FIG. 3A), the longitudinal axis 168 of the interface frame 116 may be about parallel to the longitudinal axis 164 of the support beam 102. Additionally, an embodiment may include a length 154 shown in FIG. 2, achieving about 45 degrees at first angle 133. The first strut 104 may be capable of achieving any length 154 between that of FIG. 2 and the minimum (shown in FIGS. 3A and 3B), and, thus, a degree of first angle 133 may be between about 0 degrees and predetermined degree amount, for example, about 45 degrees, about 60 degrees, about 90 degrees, about 120 degrees, etc. For example, as shown in FIG. 4A, the length 154 of the first strut 104 has been reduced to an intermediate length 154 (between that shown in FIG. 2 and that shown in FIG. 3A). As such, first angle 133 in FIG. 4A has been reduced to, for example, about 20 degrees.

Figure 5:
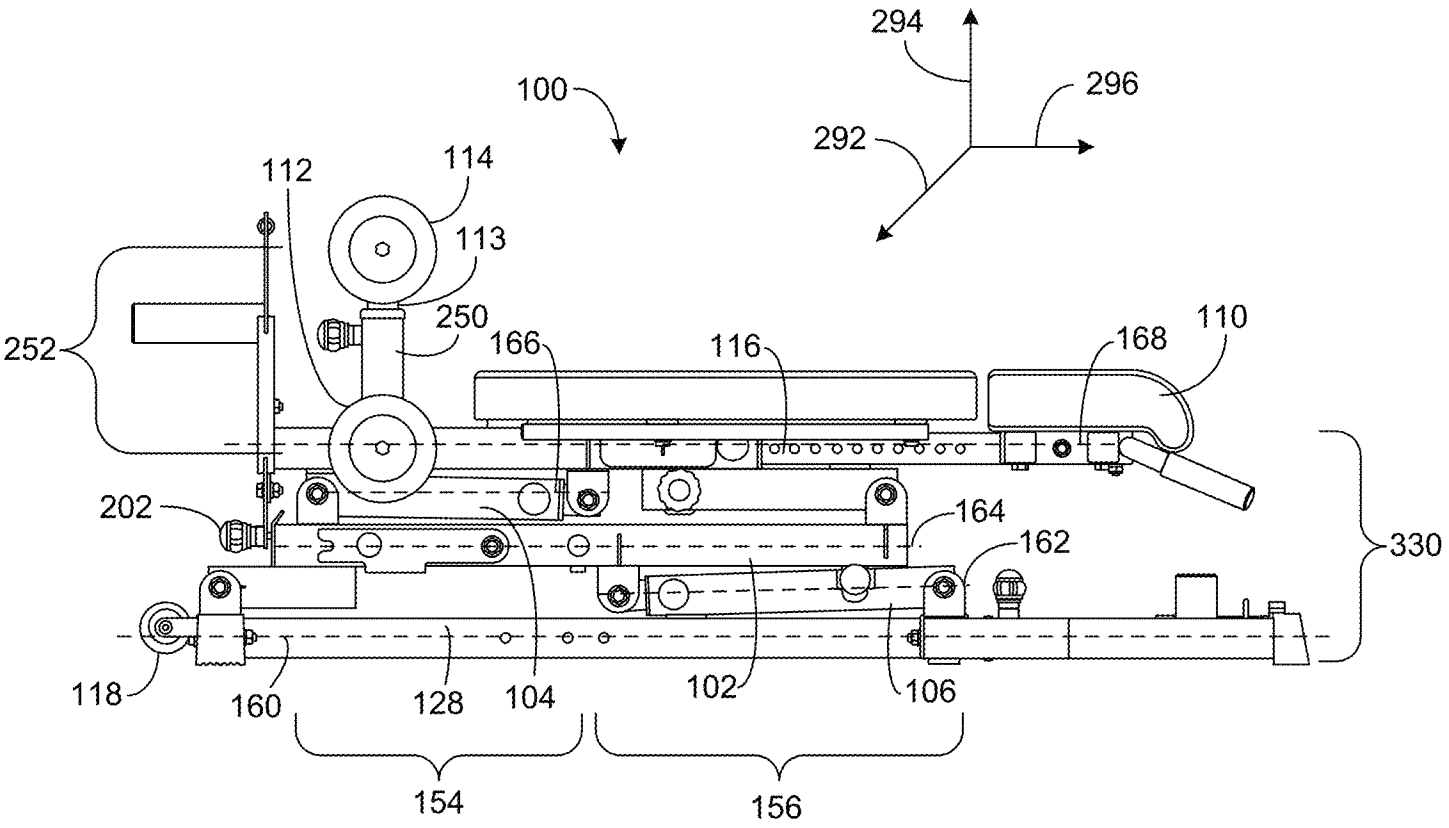
FIG. 5 illustrates an embodiment of a multi-configuration exercise device in an example configuration, also known as a collapsed configuration.

FIG. 5 illustrates an embodiment of a multi-configuration exercise device 100 in an example configuration, also described as a collapsed configuration. When adjusted in this manner, the device 100 may be used by a user to perform hamstring exercises (e.g., glute-ham development), and/or abdominal exercises (e.g., sit-ups). The first strut 104 is adjusted to the minimum length 154, as described for FIG. 3A, such that the longitudinal axis 168 of the interface frame 116 is approximately parallel to the longitudinal axis 166 of the first strut 104, and both the longitudinal axis 168 of the interface frame 116 and the longitudinal axis 166 of the first strut 104 are approximately parallel to the longitudinal axis 164 of the support beam 102. Further, the length 156 of the second strut 106 is adjusted to a minimum length 156. When the second strut 106 is reduced to the minimum length 156, the longitudinal axis 162 of the second strut 106 is approximately parallel to the longitudinal axis 160 of the base frame 128, and both the longitudinal axis 162 of the second strut 106 and the longitudinal axis 160 of the base frame 128 are both approximately parallel to the longitudinal axis 164 of the support beam 102. With longitudinal axes 168, 166, 164, 162, 160 being approximately parallel, the device 100 includes a minimum height 330 of the interface frame 116. The minimum height 330 of the interface frame 116 may be about 15 cm to about 40 cm; about 20 cm to about 35 cm; etc. As shown in FIGS. 3A, 4A, and 5, the longitudinal axis 164 of the support beam 102 may be manipulated with respect to the longitudinal axis 160 of the base frame 128, as described by second angle 134 (shown in FIG. 2), over a range of degrees, for example about 0 degrees (i.e., the longitudinal axis 164 of the support beam 102 being approximately parallel to the longitudinal axis 160 of the base frame 128) to about 120 degrees; about 0 degrees to about 90 degrees; about 0 degrees to about 60 degrees; about 0 degrees to about 45 degrees; etc. The number of degrees achieved at second angle 134 are a function of the adjusted length 156 of the second strut 106. For example, the second strut 106 at a minimum length 156, the longitudinal axis 164 of the support beam 102 may be about parallel to the longitudinal axis 160 of the base frame 128, as shown in FIG. 5. Additionally, an embodiment may include a predetermined length 156 of the second strut 106, achieving about 45 degrees at second angle 134, as shown in FIGS. 2 and 3A. The second strut 106 may be capable of achieving any length 156 between the predetermined length 156 shown in FIGS. 2 and 3A and the minimum (shown in FIG. 5), and, thus, any degree second angle 134 between about 0 degrees and a predetermined degree amount (e.g., about 45 degrees to about 120 degrees, about 45 degrees, about 60 degrees, about 90 degrees, about 120 degrees, etc.). For example, as shown in FIG. 4A, the length 156 of the second strut 106 has been reduced to an intermediate length 156 (i.e., between the length shown in FIGS. 2 and 3A and the minimum length shown in FIG. 5). As such as shown in FIG. 4A, second angle 134 has been reduced to, for example, about 15 degrees. FIGS. 4A and 4B illustrate an embodiment of a multi-configuration device 100 in an example configuration. This configuration includes the second strut 106 at a reduced length 156, such that the first angle 133 is greater than the second angle 134. When adjusted in this manner, the device 100 may be used by a user to perform hamstring exercises (e.g., glute-ham development at increased difficulty), and/or abdominal exercises (e.g., sit-ups).

The height 330 and orientation of the interface frame 116 with respect to the base frame 128 of the multi-configuration exercise device 100 as described may be adjusted in a multitude of ways. For example, the length 154 of the first strut 104 may be shortened or lengthened (e.g., by manipulating first portion 103*a* relative to second portion 103*b*) to decrease or increase the first angle 133, respectively. In combination, or independently, the second strut 106 length 156 may be shortened or lengthened (e.g., by manipulating first portion 105*a* relative to second portion 105*b*) to decrease or increase the second angle 134, respectively. The height 330 of the interface frame 116 may be adjusted in this fashion from a collapsed height 330 (shown in FIG. 5) to an expanded height 330 (shown in FIG. 2), or any height therebetween. Within the aforementioned height range, the interface frame 116 may be angled with respect to the base frame 128 to include incline angle 351*a* or decline angle 351*b*. Incline angle 351*a* and decline angle 351*b* may be about 0 degrees (i.e., the longitudinal axis 168 of the interface frame 116 being parallel to the longitudinal axis 160 of the base frame 128) to about 90 degrees; about 0 degrees to about 60 degrees; about 0 degrees to about 45 degrees; etc. At any point of manipulation, the length 158 (shown in FIG. 2) of interface frame 116 may be extended or retracted.

Figure 8:
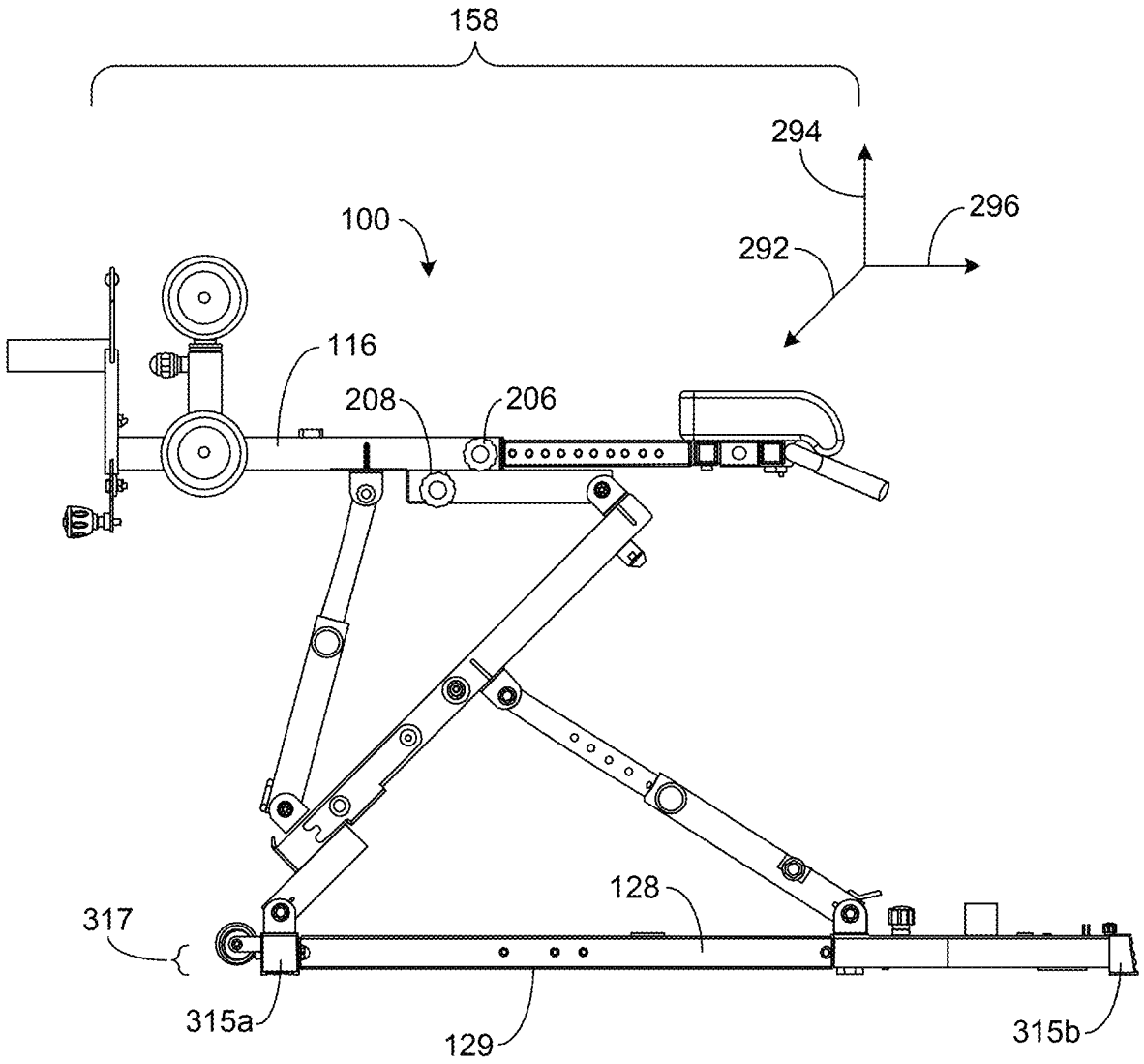
FIG. 8 illustrates an embodiment of a multi-configuration exercise device in an example configuration with the first pad removed.

Returning to FIGS. 1-2, which shows that the interface frame 116 may include a first portion 115*a* and a second portion 115*b*. In some embodiments, the first portion 115*a* may fit within the second portion 115*b* (e.g., the first portion 115*a* including a smaller outer diameter tube fitting within a larger outer diameter tube of the second portion 115*b*). The interface frame 116 may be extendable and retractable by sliding the first portion 115*a* out of or into the second portion 115*b*, respectively. The length 158 (shown in FIG. 2) may be adjustable between about 0.50 m to about 1.50 m; about 0.60 m to about 1.25 m; about 0.70 m to about 1.12 m; etc. In addition, the first pad 108 may be removable during any point of orientation or height manipulation of the interface frame 116. For example, as shown in FIG. 8, the first pad 108 may be removed while the device 100 is adjusted to the expanded configuration. Adjusted in this way, the device 100 may be useful for lower back (e.g., back extensions), hamstring exercises (e.g., glute-ham development) or abdominal exercises (e.g., sit-ups). The length 158 of the interface frame 116 may be adjusted for users of varying heights. The first pad 108 may be removed and the interface frame 116 length 158 may be adjusted, for example, while the device 100 is adjusted as shown and described for FIGS. 1-5 or any configuration therebetween.

Figure 7:
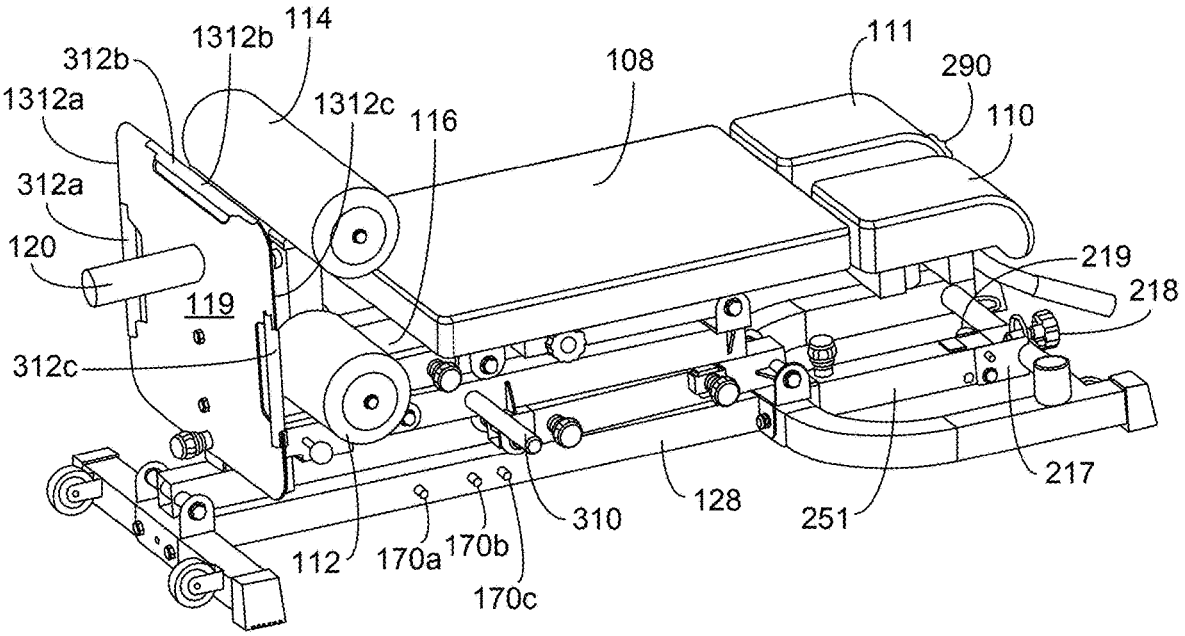
FIG. 7 illustrates a perspective view of an embodiment of a multi-configuration exercise device in an example configuration.
Figure 9:
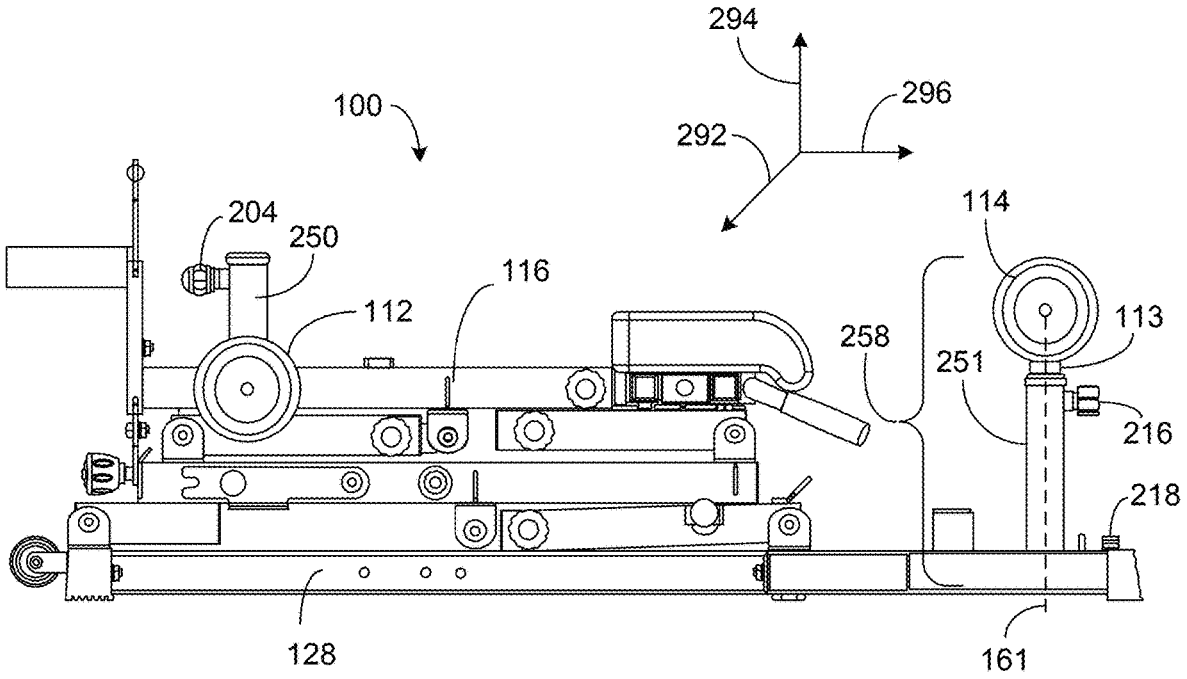
FIG. 9 illustrates an embodiment of a multi-configuration exercise device in an example configuration.
Figure 10:
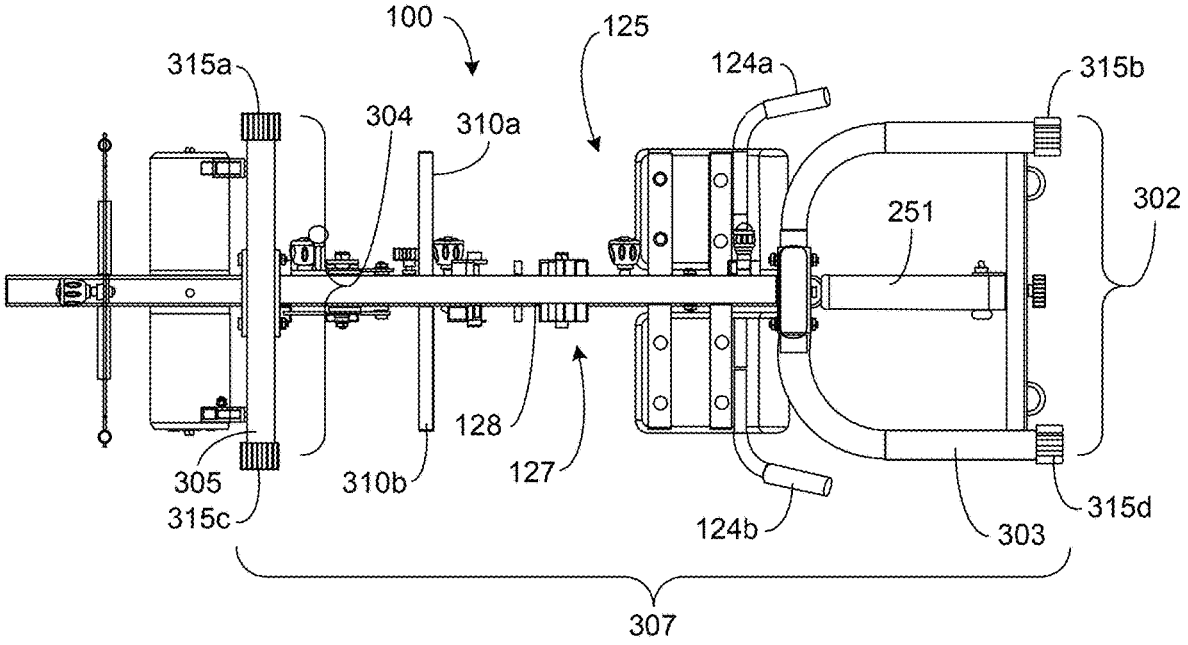
FIG. 10 illustrates a bottom perspective of an embodiment of a multi-configuration exercise device.
Figure 15:
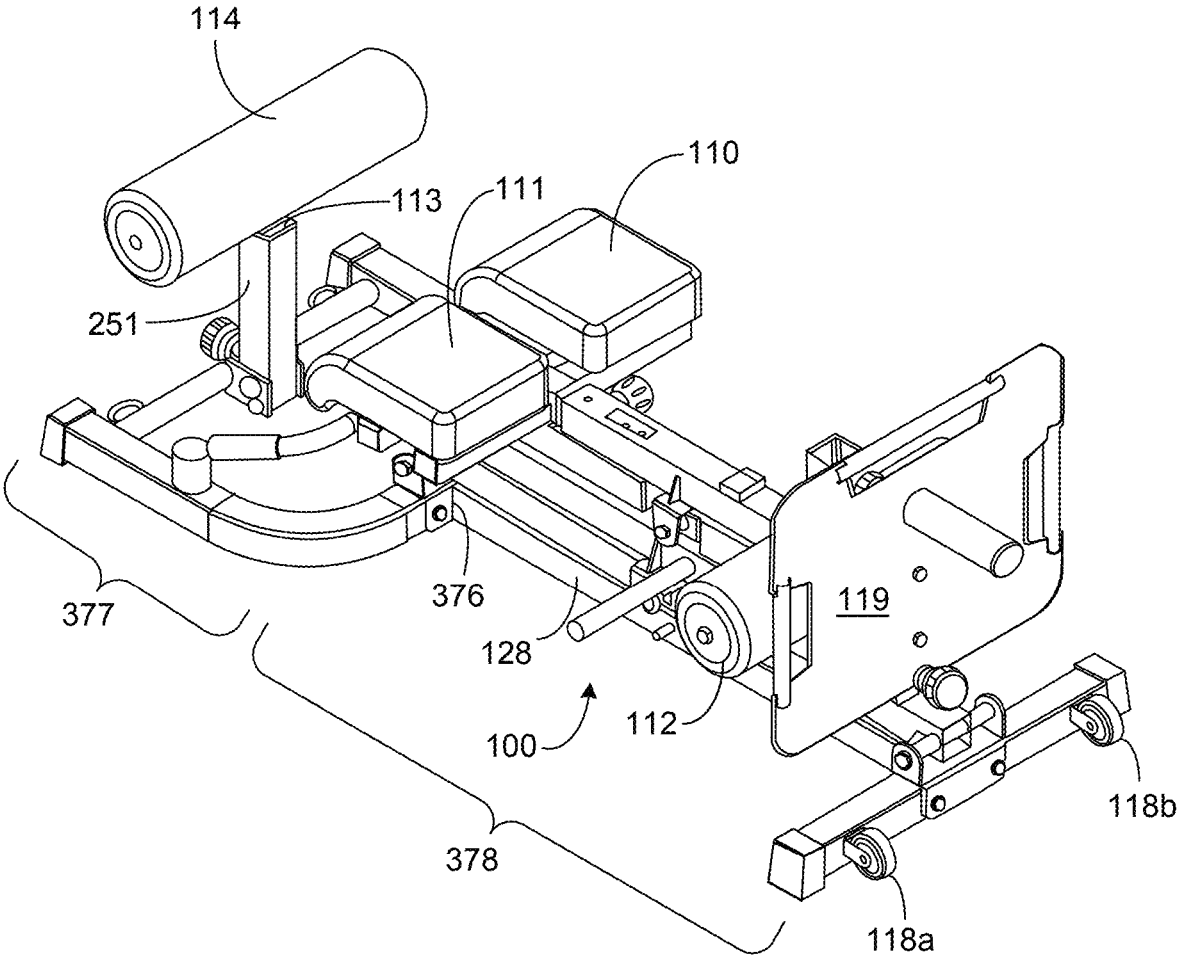
FIG. 15 illustrates a perspective view of an embodiment of a multi-configuration exercise device in an example configuration.
Figure 16:
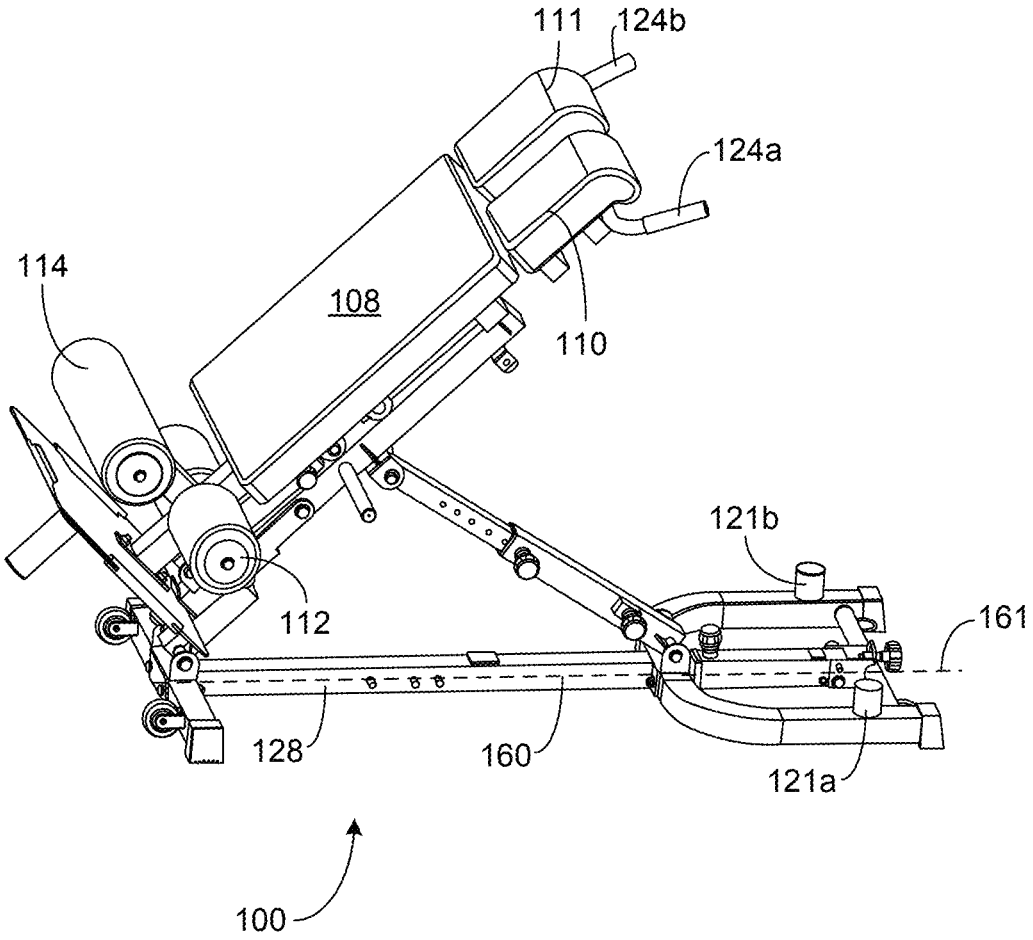
FIG. 16 illustrates a perspective view of an embodiment of a multi-configuration exercise device in an example configuration.

FIG. 5 illustrates an adjustable dimension 252 between cylindrical pad 114 and cylindrical pad 112. The first cylindrical pad 114 may include a coupling feature 113 and the coupling feature 113 may fit within column 250 (e.g., column 250 including a tube, such as a square tube, with a larger inner diameter than the outer diameter of a similarly shaped portion of coupling feature 113). As such, the first cylindrical pad 114 may be adjusted toward the second cylindrical pad 112, decreasing dimension 252, or adjusted away from the second cylindrical pad 112, increasing dimension 252. Some embodiments may include a multi-positional post 251 (shown in FIG. 7). Post 251 may be positioned as shown in FIGS. 7, 10 and 16, such that the longitudinal axis 161 (shown in FIG. 16) of the post 251 is approximately parallel to the longitudinal axis 160 of the base frame 128. Alternatively, the post 251 may be positioned as shown in FIGS. 9 and 15, such that the longitudinal axis 161 of the post 251 is aligned approximately perpendicular to the longitudinal axis 160 of the base frame 128 and approximately parallel to the vertical axis 294. The coupling feature 113 may fit within post 251 (e.g., post 251 may be a tube, such as a square tube, with a larger inner diameter than the outer diameter of a similarly shaped portion of the coupling feature 113).

FIGS. 9 and 15 illustrates the device 100 in an example configuration in which the first cylindrical pad 114 is coupled to the base frame 128 instead of the interface frame 116. When adjusted in this manner, the device 100 may be used by a user to perform multiple muscle group engaging exercise (e.g., hip thrusts), and/or unique stretches (e.g., quadricep stretches). As exemplified in FIG. 9, a cylindrical pad (e.g., the first cylindrical pad 114) is removed from being coupled to the interface frame 116 and coupled to the base frame 128 at height 258, defined by the top of the cylindrical pad (e.g., the first cylindrical pad 114) to the surface upon which the device 100 rests. The height 258 may be appropriate for the aforementioned exercises and/or stretches, for example, in a range of about 20 cm to about 60 cm; about 25 cm to about 55 cm; about 30 cm to about 50 cm; about 35 cm to about 45 cm; etc. Further, the cylindrical pad (e.g., the first cylindrical pad 114) may be adjustable, such that, height 258 may be adjusted. In some embodiments, the first cylindrical pad 114 is coupled to the first portion 337 of the base frame 128 and not to the second portion 378 of the base frame 128, such that exercises and/or stretches involving the first cylindrical pad 114 are not impeded by the proximal presence of the base plate 119. As shown in the example configuration, the coupling feature 113 of the first cylindrical pad 114 is removed from column 250 and slidingly received by post 251 such that the first cylindrical pad 114 is removably coupled to the post 251. As such, a height 258 may be created between the surface that the device 100 is resting upon and the first cylindrical pad 114. The height 258 of the first cylindrical pad 114 is adjustable by sliding the coupling feature 113 into the post 251 to decrease the height 258 of the first cylindrical pad 114 or sliding the coupling feature 113 out of the post 251 to increase the height 258 of the first cylindrical pad 114.

The multi-configuration device 100 utilizes a multitude of user control elements to achieve and maintain desired configurations. For example, some embodiments may employ spring-loaded pins, friction locks, or combinations of spring-loaded pins and friction locks. Elements of the device 100 which include a first portion sliding into and out of a second portion may utilize spring-loaded pins and/or friction locks to lock the position of the first portion with respect to the second portion. For example, embodiments may include the first portion 103*a* of the first strut 104 sliding into and out of the second portion 103*b* of the first strut 104 (shown in FIG. 1), the first portion 105*a* of the second strut 106 sliding into and out of the second portion 105*b* of the second strut 106 (shown in FIG. 1), the first portion 115*a* of the interface frame 116 sliding into or out of the second portion 115*b* of the interface frame 116 (shown in FIG. 1), or the coupling feature 113 (being similar to a first portion) sliding into or out of the column 250 (acting similar to a second portion) or the post 251 (shown in FIG. 9) (acting similar to a second portion). As such, the first portion (e.g., the first portion 103*a* of the first strut 104, the first portion 105*a* of the second strut 106, the first portion 115*a* of the interface frame 116, and the coupling feature 113 of the first cylindrical pad 114) may define apertures which align with a spring-loaded pin, biased perpendicularly to the longitudinal axis (e.g., 166, 162, 168) of the adjustable element (e.g., the first strut 104, the second strut 106, and the interface frame 116). Defined apertures within first portions may include predetermined positions to achieve desired configurations. Further, pin assemblies may include lash removing mechanisms. For example, pin assemblies may include a threaded advancement to force the pin, including a larger diameter portion of a beveled portion, into the defined aperture, thus removing lash.

Figure 6:
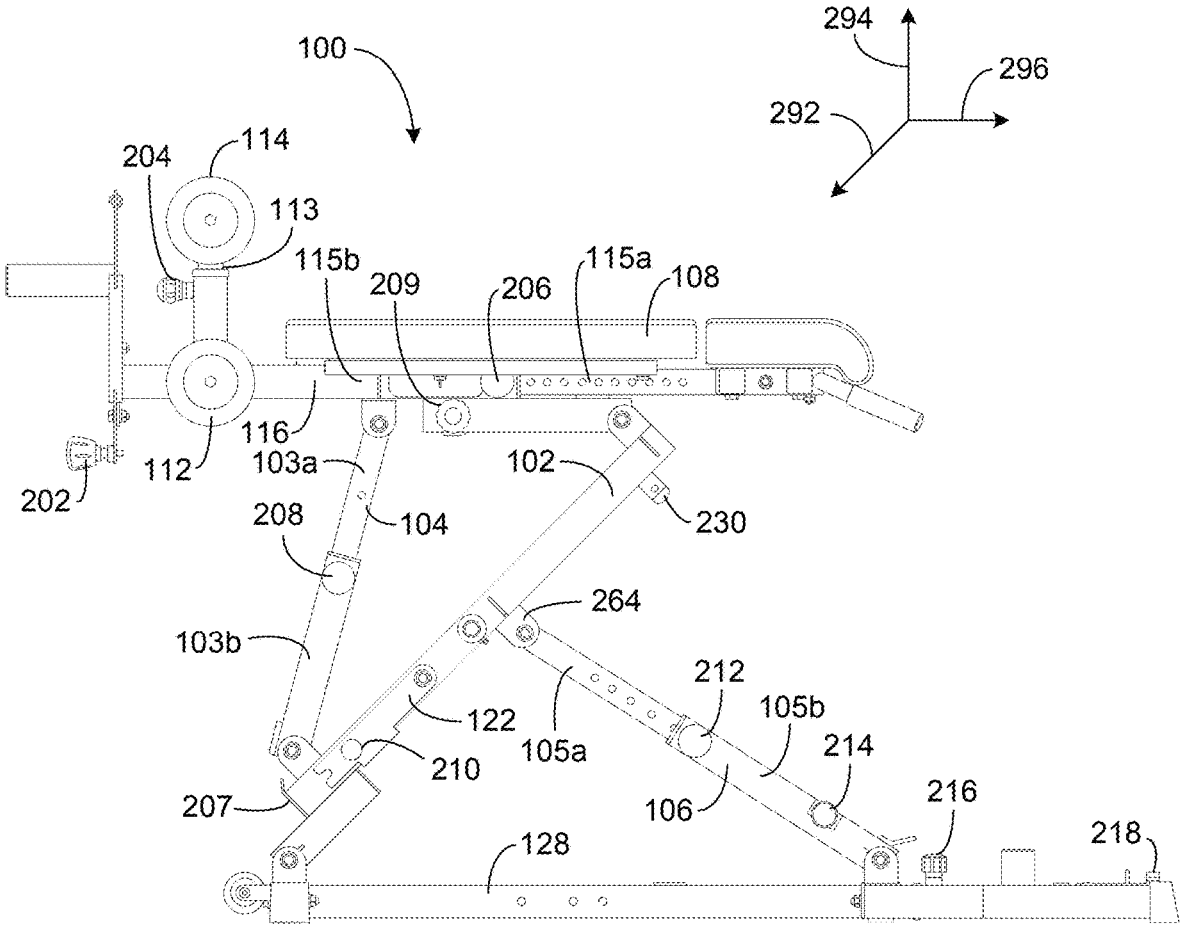
FIG. 6 illustrate various user controls of an embodiment of a multi-configuration exercise device.

For example, as shown in FIG. 6, spring-loaded pin assembly 208 may be operatively coupled to the second portion 103*b* of the first strut 104 such that the pin of the assembly 208, biased towards the first portion 103*a* of the first strut 104, engages with an aperture defined by the first portion 103*a* of the first strut 104. Once the pin of the pin assembly 208 engages with an aperture defined by the first portion 103*a* of the first strut 104, the first portion 103*a* of the first strut 104 is locked with respect to the second portion 103*b* of the first strut 104. The first portion 103*a* may include indicia indicating information about the defined aperture with which the pin of the pin assembly 208 is engaged. For example, indicia may indicate the resulting first angle 133 due the resulting length 154 (shown in FIG. 2) at the defined aperture in which the pin of the pin assembly 208 is engaged (e.g., 10 degrees, 20 degrees, 45 degrees, etc.).

For example, as shown in FIG. 6, spring-loaded pin assembly 212 may be operatively coupled to the second portion 105*b* of the second strut 106 such that the pin of the assembly 212, biased towards the first portion 105*a* of the second strut 106, engages with an aperture defined by the first portion 105*a* of the second strut 106. Once the pin of the pin assembly 212 engages with an aperture defined by the first portion 105*a* of the second strut 106, the first portion 105*a* of the second strut 106 is locked with respect to the second portion 105*b* of the second strut 106. The first portion 105*a* may include indicia indicating information about the defined aperture with which the pin of the pin assembly 212 is engaged. For example, indicia may indicate the resulting second angle 134 due to the resulting length 156 of strut 106 (shown in FIG. 2) based on the defined aperture in which the pin of the pin assembly 208 is engaged (e.g., about 10 degrees, about 20 degrees, about 25 degrees, about 30 degrees, about 35 degrees, about 40 degrees, about 45 degrees, etc.).

For example, as shown in FIG. 6, spring-loaded pin assembly 206 may be operatively coupled to the second portion 115*b* of the interface frame 116 such that the pin of the assembly 206, biased towards the first portion 115*a* of the interface frame 116, engages with an aperture defined by the first portion 115*a* of the interface frame 116. Once the pin of the pin assembly 206 engages with an aperture defined by the first portion 115*a* of the interface frame 116, the first portion 115*a* of the interface frame 116 is locked with respect to the second portion 115*b* of the interface frame 116. The first portion 115*a* may include indicia indicating information about the defined aperture with which the pin of the pin assembly 212 is engaged. For example, indicia may be representative of settings (e.g., 1, 2, 3, 4, 5, 6, 7, 8, 9, 10, etc.) of length 158 of the interface frame (shown in FIG. 2) at the defined aperture in which the pin of the pin assembly 206 is engaged.

For example, as shown in FIG. 6, spring-loaded pin assembly 204 may be operatively coupled to the column 250 such that the pin of the assembly 204, biased towards the coupling feature 113 of the first cylindrical pad 114, engages with a defined aperture of the coupling feature 113 of the first cylindrical pad 114. Once the pin of the pin assembly 204 engages with an aperture defined by the coupling feature 113 of the first cylindrical pad 114, the coupling feature 113 of the first cylindrical pad 114 is locked with respect to the column 250. The coupling feature 113 may include indicia indicating information about the defined aperture with which the pin of the pin assembly 204 is engaged.

For example, as shown in FIG. 6, spring-loaded pin assembly 216 may be operatively coupled to the post 251 (shown in FIG. 9) such that, when the device 100 is adjusted to the collapsed configuration, the pin of the pin assembly 216, biased towards the coupling feature 113 of the first cylindrical pad 114, engages with a defined aperture of the coupling feature 113 of the first cylindrical pad 114. Once the pin of the pin assembly 216 engages with an aperture defined by the coupling feature 113 of the first cylindrical pad 114, the coupling feature 113 of the first cylindrical pad 114 is locked with respect to the post 251. The coupling feature 113 may include indicia indicating information about the defined aperture with which the pin of the pin assembly 216 is engaged.

For example, spring-loaded pin assembly 202 may be used in locking the interface frame 116 in an orientation in which the longitudinal axis 168 of the interface frame 116 is approximately parallel to the longitudinal axis 164 of the support beam 102 (as shown in FIGS. 3A and 5). As shown in FIG. 6, the support beam 102 may include a locking interface 207 which defines a locking aperture. When the device 100 is adjusted such that the pin assembly 202 comes into contact with the locking interface 207, the pin of the pin assembly 202, biased toward the locking interface 207, is forced into the defined aperture of the locking interface 207. When the pin of the pin assembly 202 engages with the defined aperture of the locking interface 207, the orientation of the interface frame 116 is locked, with respect to the support beam 102.

For example, spring-loaded pin assembly 214 may be used in locking the support beam 102 in an orientation in which the longitudinal axis 164 of the support beam 102 is approximately parallel to the longitudinal axis 160 of the base frame 128 (as shown in FIG. 5). As shown in FIG. 6, the support beam 102 includes coupling tab 230. Coupling tab 230 includes a defined aperture. When the device 100 is adjusted such that the longitudinal axis 160 of the base frame 128 is parallel to the longitudinal axis 164 (shown in FIG. 5) of the support beam 102, the pin of the pin assembly 214, biased toward the coupling tab 230, engages with the defined aperture of coupling tab 230 and locks the longitudinal axis 160 of the base frame 128 approximately parallel to the longitudinal axis 164 (shown in FIG. 5) of the support beam 102.

For example, as shown in FIG. 7, the device 100 includes a coupling 217 for coupling the post 251 to the base frame 128. The coupling 217 hingedly couples the post 251 to the base frame 128 and includes a defined aperture. The post 251 may define one or more apertures that align with the defined aperture of the coupling 217. For example, the defined aperture of the coupling 217 may align with a defined aperture of the post 251 when the longitudinal axis 161 of the post 251 is aligned with the longitudinal axis 160 of the base frame 128 (as shown in FIG. 16). As such, a pin 219 may be placed through the aligned apertures locking the post 251 in the configuration shown in FIGS. 7 and 16. Pin 219 may be removed and the post 251 may be rotated to align the longitudinal axis 161 approximately parallel to the vertical axis 292 (shown in FIG. 9). The pin 219 may be positioned within the defined aperture of the coupling 217 and within one of the defined apertures of the post 251, locking the post 251 with the longitudinal axis 161 approximately parallel to the vertical axis 292 (shown in FIG. 9). It may be advantageous for pin 219 to include lash for ease of insertion and removal of pin 219. Some embodiments of the device 100 may include a fastener assembly 218 to remove the lash from pin 219 and the resulting wobble of post 251 during use. Fastener assembly 218 may be rotated in a first direction (e.g., clockwise) to advance a threaded member into contact with the post 251, driving the post 251 into firm contact with pin 219, and removing wobble from the post 251. Rotating the fastener assembly 218 in a second direction (e.g., counterclockwise) may remove the threaded member from driving the post 251 into the pin 219, introducing clearance for removal of pin 219.

For example, the device 100 may include a fastener assembly 209 (shown in FIG. 6) for the attachment of the first pad 108. The first pad 108 may include a coupling feature (not shown) which fits within a defined aperture of the first portion 115*a* and/or the second portion 115*b* of the interface frame 116, and into an engagement area of the fastener assembly 209. If the fastener assembly 209 is rotated in a first direction (e.g., clockwise), a threaded element advances toward the coupling feature of the first pad 108, frictionally locking the first pad 108 with respect to the interface frame 116. If the fastener assembly 209 is rotated in a second direction (e.g., counterclockwise), the threaded element may be retracted from contact with the coupling feature of the first pad 108, introducing clearance for the removal of the first pad 108.

The multi-configuration exercise device 100 may include an auxiliary support beam 122 shown in FIGS. 1, 4A, and 6. In some embodiments, it may be advantageous to couple the support beam 102 to the base frame 128 to support the support beam 102, for example, when the support beam 102 is at a low-degree second angle 134 (shown in FIG. 4A), with respect to the base frame 128. As shown in FIG. 4A, the support beam 102 may include an auxiliary support beam 122 hingedly coupled to the support beam 102 via coupling 421. The base frame 128 may include a plurality of coupling features 170*a*, 170*b*, 170*c*. The coupling features 170*a*, 170*b*, 170*c* are exemplified as extruded studs extending from the base frame 128. Other examples of coupling features may include defined apertures, in which the auxiliary support beam 122 may include a complementary portion, or a unidirectional geometrically shaped coupling feature 11 (shown in FIGS. 14A, 14B, and 14C), in which the auxiliary support beam 122, when engaged with, is only allowed to adjust in one direction (e.g., similar to a unidirectional saw-tooth pattern). As shown, the auxiliary support beam 122 may include an interfacing edge that is complementary to each respective coupling feature 170*a*, 170*b*, 170*c*, such that the auxiliary support beam 122 locks into position through interaction with a coupling feature 170*a*, 170*b*, 170*c*. Each coupling feature 170*a*, 170*b*, 170*c* is respective to a different number of degrees of second angle 134. For example, engaging auxiliary support beam 122 with the first coupling feature 170*a* may result in an about 15-degree second angle 134. For example, engaging auxiliary support beam 122 with the second coupling feature 170*b* may result in an about 10-degree second angle 134. For example, engaging auxiliary support beam 122 with the third coupling feature 170*c* may result in an about 5-degree second angle 134. Indicia representing the resulting degrees of second angle 134 may be positioned on the base frame 128 near each coupling feature 170*a*, 170*b*, 170*c* to inform a user of the achieved second angle 134 when the auxiliary support beam 122 is engaged with the respective coupling feature 170*a*, 170*b*, 170*c*. Inversely, the auxiliary support beam could be hingedly coupled to the base frame 128 and interface with coupling features 170*a*, 170*b*, 170*c* coupled to the support beam 102. Alternatively, as shown in FIG. 14C, some embodiments may include a unidirectional adjustment interface 171 for the auxiliary support beam 1122 to interface with. For example, the base frame 128 may include a unidirectional adjustment interface 171 coupled to the base frame 128. The unidirectional adjustment interface 171 may include an appropriate geometric shape, in which the auxiliary support beam 1122, when engaged with unidirectional adjustment interface 171, is adjustable in one direction (e.g., a unidirectional saw-tooth pattern). As such, the support beam 102 may achieve a plurality of angle 134 (shown in FIG. 2) adjustments while being angled towards a vertical orientation (i.e., aligned with the vertical axis 294), and prevented from angling back towards a horizontal orientation (i.e., aligned with the horizontal axis 296). The auxiliary support beam 1122 may be held out of engagement with the unidirectional adjustment interface 171 to angle the auxiliary support beam 1122 towards a horizontal orientation. As shown in FIG. 6, the auxiliary support beam 122 may include a knob 210 for ease of use. Additionally, the auxiliary support beam 122 may be magnetically coupled to the support beam 102. Magnetically coupling the auxiliary support beam 122 to the support beam 102 ensures the auxiliary support beam 122 is stored during configurations in which it is not advantageous to use the auxiliary support beam 122 and allows for easy deployment of the auxiliary support beam 122 for use. Some embodiments include an auxiliary support beam 122 capable of achieving the degree adjustments of angle 134 that the second strut 106 is able to, thus, these embodiments may not include a second strut 106.

Figure 18:
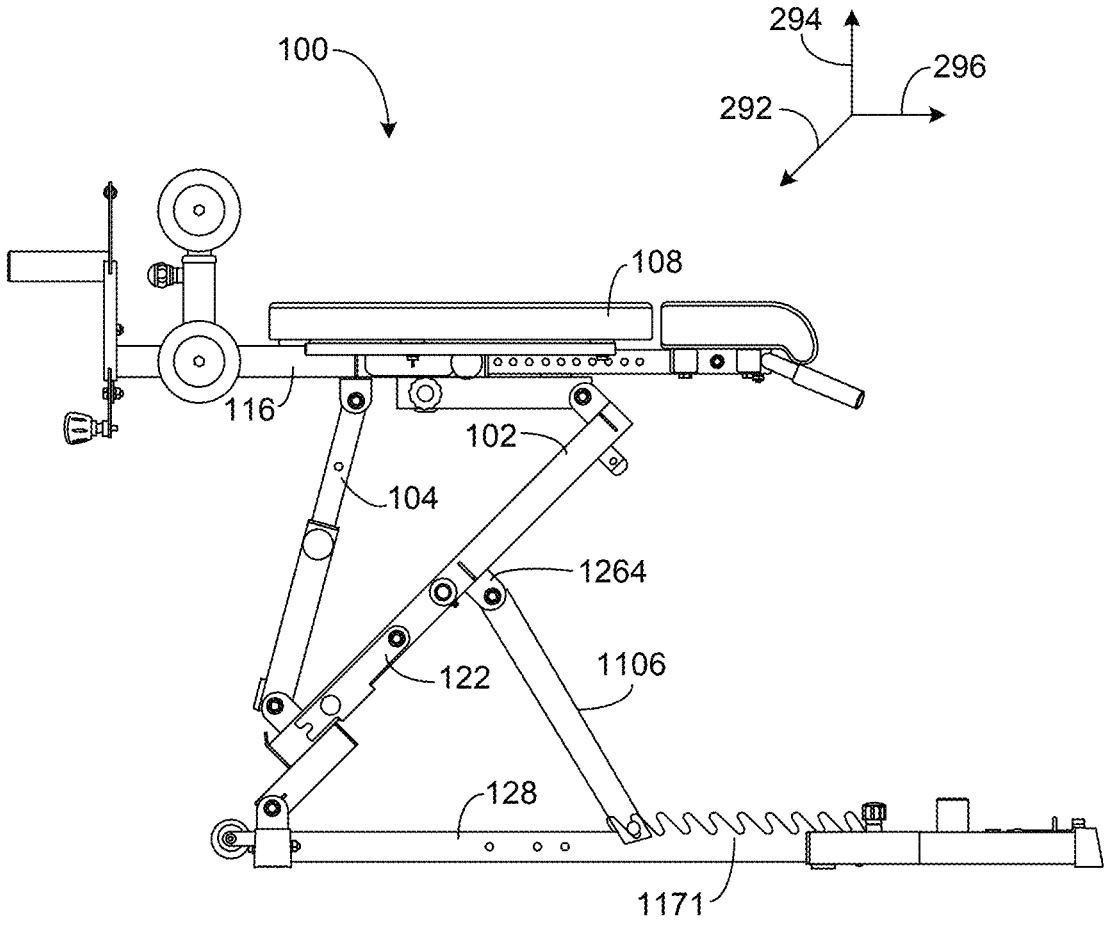
FIG. 18 illustrates a perspective view of an embodiment of a multi-configuration exercise device with a swing brace for support beam angle adjustments.

As shown in FIG. 18, some embodiments may include a swing brace 1106 hingedly coupled to the support beam 102 by coupling 1264. Embodiments utilizing the swing brace 1106 may use the swing brace 1106 for the capabilities described for the second strut 106 (shown in FIGS. 1-3A, 4A, 5 and 6). The base frame 128 may include a unidirectional adjustment interface 1171 coupled to the base frame 128. The unidirectional adjustment interface 1171 may include a geometric shape, in which the swing brace 1106, when engaged with unidirectional adjustment interface 1171, is adjustable in one direction (e.g., a unidirectional saw-tooth pattern). As such, the support beam 102 may achieve a plurality of adjustments of angle 134 (shown in FIG. 2) while being angled towards a vertical orientation (i.e., aligned with the vertical axis 294), and prevented from angling back towards a horizontal orientation (i.e., aligned with the horizontal axis 296). The swing brace 1106 may be removed from engagement with the unidirectional adjustment interface 1171 to angle the support beam 102 towards a horizontal orientation (i.e., aligned with the horizontal axis 296).

The multi-configuration device 100 may include a plurality of handles for ease of use. For example, as shown in FIG. 7, the base plate 119 may define one or more handles 312*a*, 312*b*, 312*c*. The illustrated embodiment includes a first handle 312*a* defined within a first side 1312*a* of the base plate 119, a second handle 312*b* defined within a second side 1312*b* of the base plate 119, and a third handle 312*c* defined within a third side 1312*c* of the base plate 119. Further, some embodiments may include handlebars, for example shown in FIG. 16, handlebars 124*a*, 124*b* may be coupled to the device 100. As shown in FIG. 10, the illustrated embodiment includes a first handlebar 124*a* coupled to the interface frame 116 extending from a first side 125 of the device 100 and a second handlebar 124*b* coupled to the interface frame 116 extending from a second side 127 of the device 100. For example, handlebar 124*a* and handlebar 124*b* may be on the same end of the interface frame but on opposite sides from one another. The device 100 may further include one or more pegs 310 (shown in FIGS. 7 and 10). As illustrated in FIGS. 7 and 10, a first peg 310*a* extends from a first side 125 of the device 100 and is coupled to the support beam 102, and a second peg 310*b* extends from a second side 127 of the device 100 and is coupled to the support beam 102. Pegs 310*a* and 310*b* and/or handles 312*a*, 312*b*, 312*c*, 124*a*, 124*b* may be useful for a user positioning their self upon and/or using the device 100.

As shown in FIG. 10, the multi-configuration exercise device 100 includes at least a portion of the base frame 128 with a width sufficient to adequately stabilize the device 100 during use by a user. For example, the base frame 128 illustrated in FIG. 10 includes a first portion 303 with a width 302 and a second portion 305 with a width 304. Widths 302 and 304 may be substantially the same or different. For example, each of widths 302 and 304 may be about 40 cm to about 100 cm; about 45 cm to about 75 cm; about 50 cm to about 60 cm; etc. The base frame 128 includes an appropriate length 307 to adequately stabilize the device 100. For example, the length 307 of the base frame 128 may about 1 m to about 2 m; about 1.25 m to about 1.75 m; about 1.30 m to about 1.50 m; etc.

Embodiments of the multi-configuration exercise device 100 may include a weight horn 120 coupled to the base plate 119, as shown in FIG. 7. The weight horn 120 may be used for adding weight to the device 100 for added stability. Additionally, the weight horn 120 may engage with a surface the device 100 rests upon in a storage configuration, for example when the device is stored vertically (shown in FIG. 11). Embodiments of the multi-configuration device 100 may include one or more flat weight pegs 121*a*, 121*b* (shown in FIG. 16). The pegs 121*a*, 121*b* may be used to add weight to the device 100 for added stability.

Figure 11:
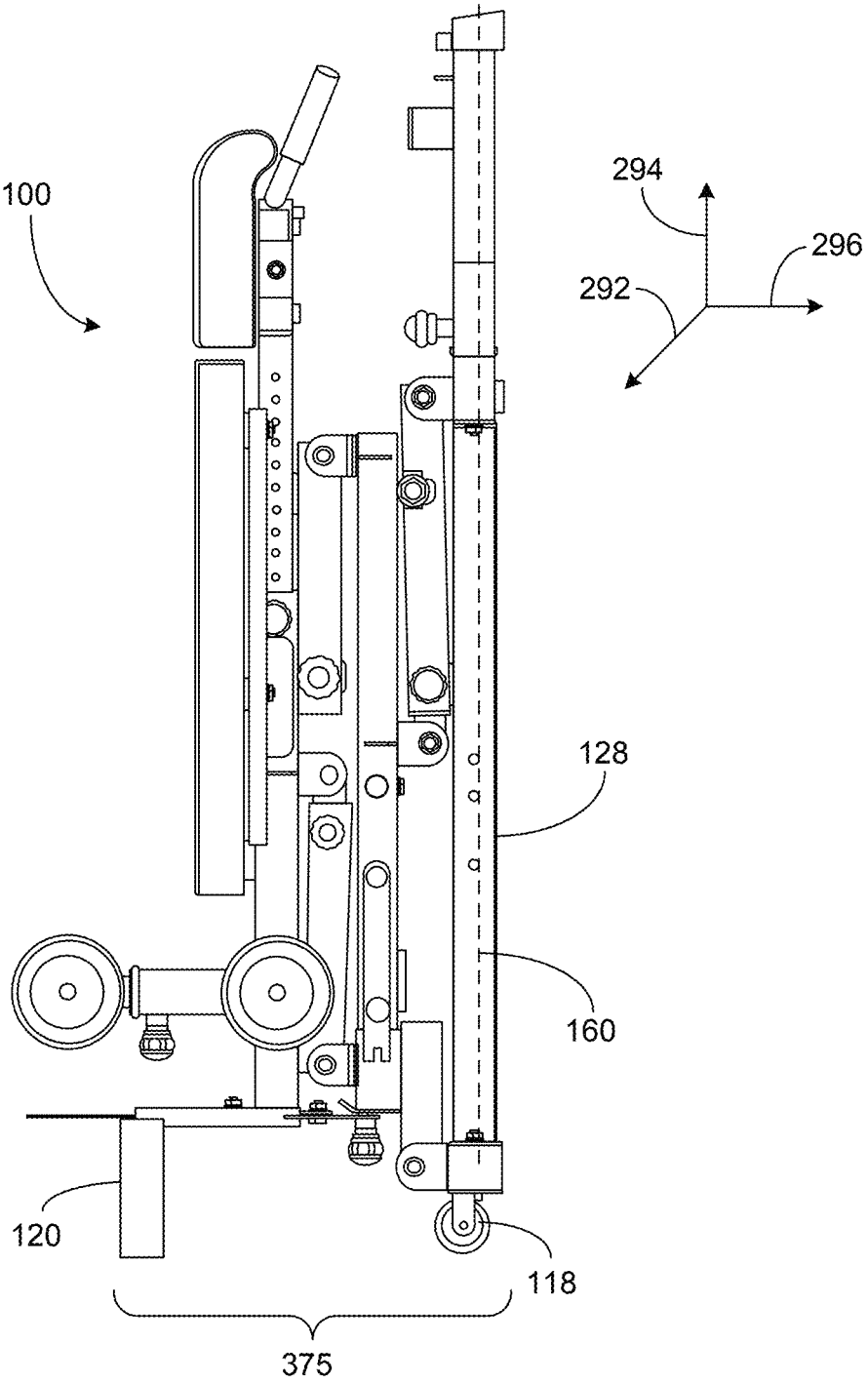
FIG. 11 illustrates an embodiment of a multi-configuration exercise device in an example configuration, also known as a storage configuration.

Embodiments of the multi-configuration exercise device 100 may be stored vertically in a storage configuration, as shown in FIG. 11. For example, the multi-configuration exercise device 100 may be adjusted to a collapsed configuration as shown and described for FIG. 5 (i.e., the longitudinal axis 168 of the interface frame 116, the longitudinal axis 166 of the first strut 104, the longitudinal axis 164 of the support beam 102, the longitudinal axis 162 of the second strut 106, and the longitudinal axis 160 of the base frame 128 being approximately parallel to one another), and oriented such that the longitudinal axis 160 of the base frame 128 is approximately parallel to the vertical axis 294. The device 100 is stabilized in the storage configuration upon a surface (e.g., the plane defined by the horizontal axis 296 and the normal axis 292) by the one or more wheels 118 and the weight horn 120. In the storage configuration, the device 100 includes a width 375 between the weight horn 120 and the one or more wheels 118. The width 375 is sufficient to stabilize the device 100 in the storage configuration. The width 375 may be about 20 cm to about 60 cm; about 30 cm to about 50 cm; etc. The one or more wheels 118 may be used to transport the device 100 to a storage area, from a storage area, or otherwise. When the device 100 is laid upon a surface (e.g., the plane defined by the horizontal axis 296 and the normal axis 292) such that the longitudinal axis 160 of the base frame 128 is approximately parallel to the surface, as shown in FIG. 5, the one or more wheels 118 (e.g., first wheel 118*a* and second wheel 118*b* shown in FIG. 15) do not contact the surface. To engage the wheels 118*a*, 118*b*, the device 100 may be lifted by a first portion 377 (shown in FIG. 15) of the base frame such that the longitudinal axis 160 of the base frame 128 is oriented at an angle between parallel to the surface and perpendicular to the surface, for example, about 25 degrees to about 50 degrees; about 25 degrees; about 35 degrees; about 45 degrees; etc. The wheels 118*a*, 118*b* engaged with the surface may be utilized to transport the device 100 to a storage area, from a storage area, or otherwise.

Figure 12:
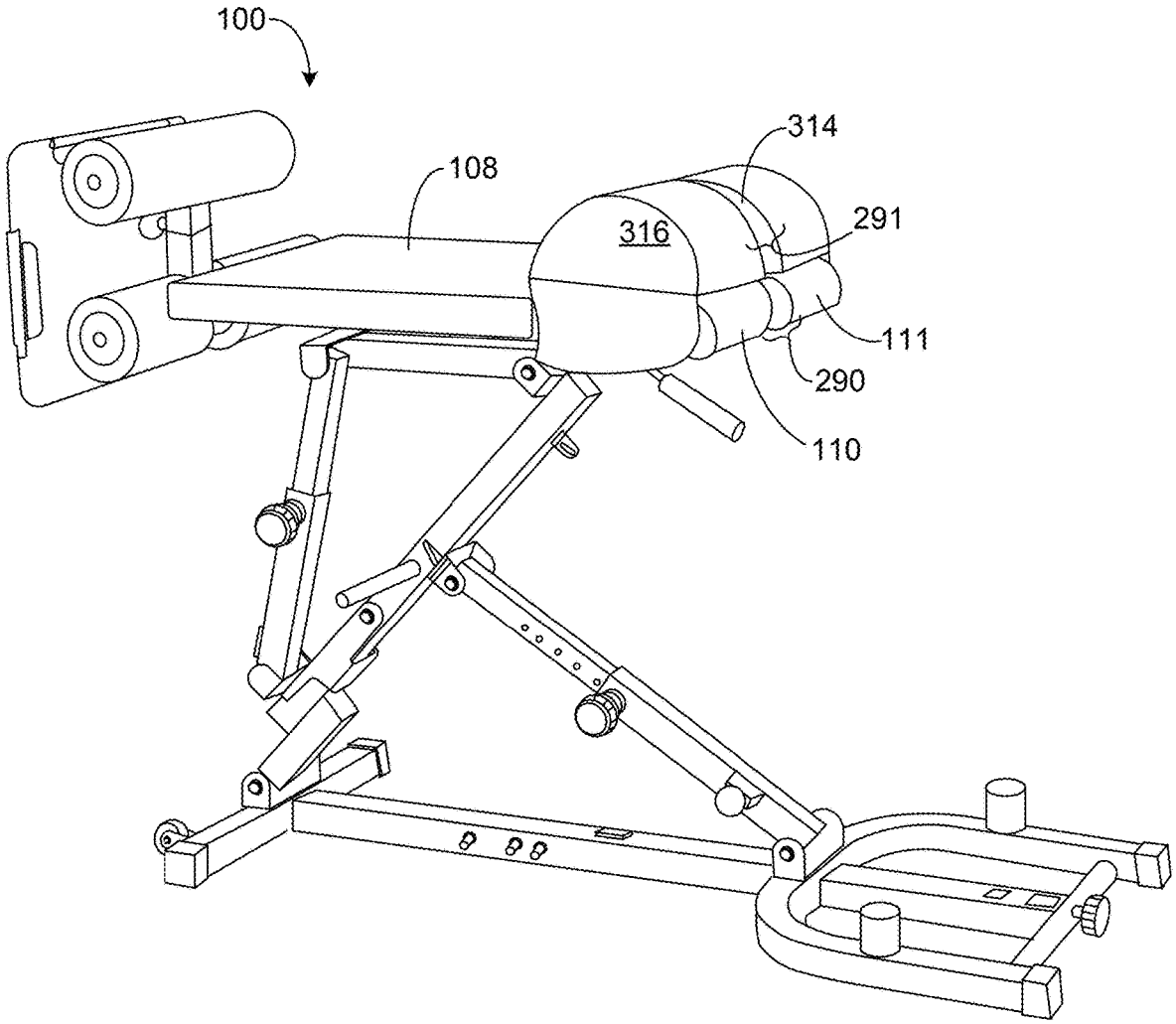
FIG. 12 illustrates an embodiment of a multi-configuration exercise device in an example configuration with a fourth pad coupled to the second pad and third pad.
Figure 13:
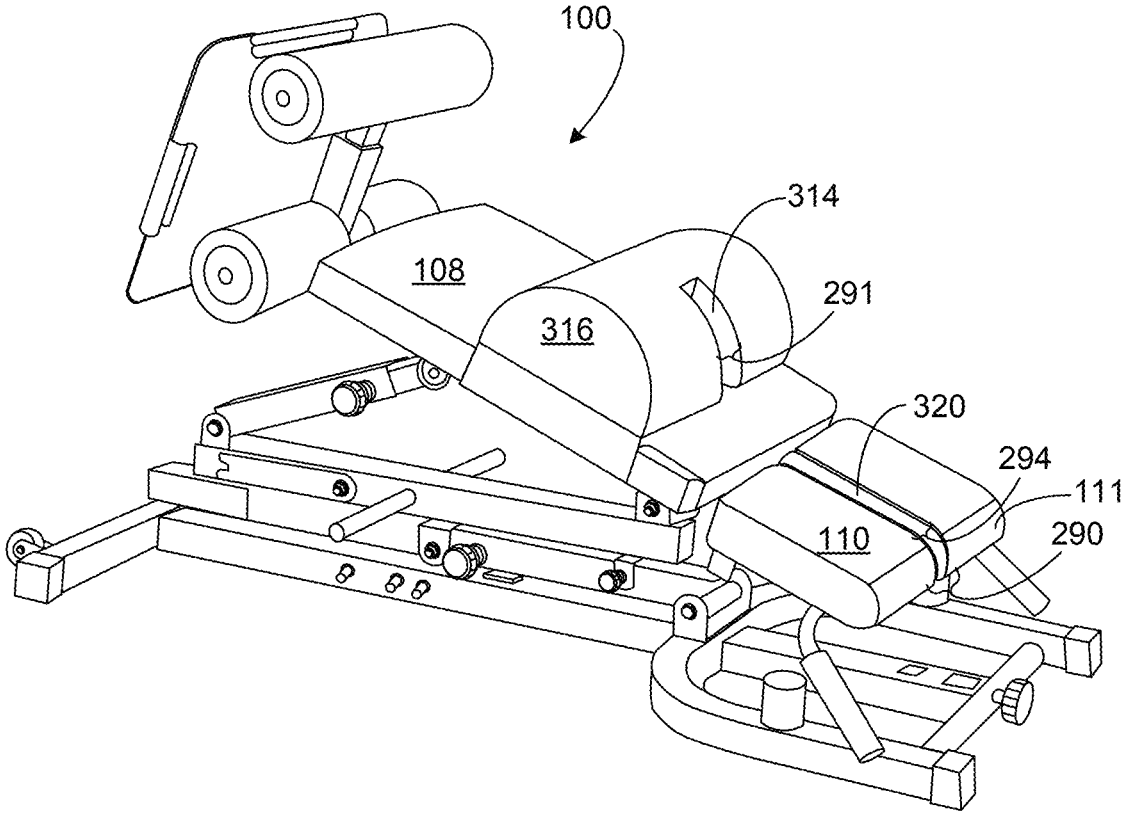
FIG. 13 illustrates an embodiment of a multi-configuration exercise device with the fourth pad coupled to the fifth pad and the first pad coupled to the interface frame.
Figure 17:
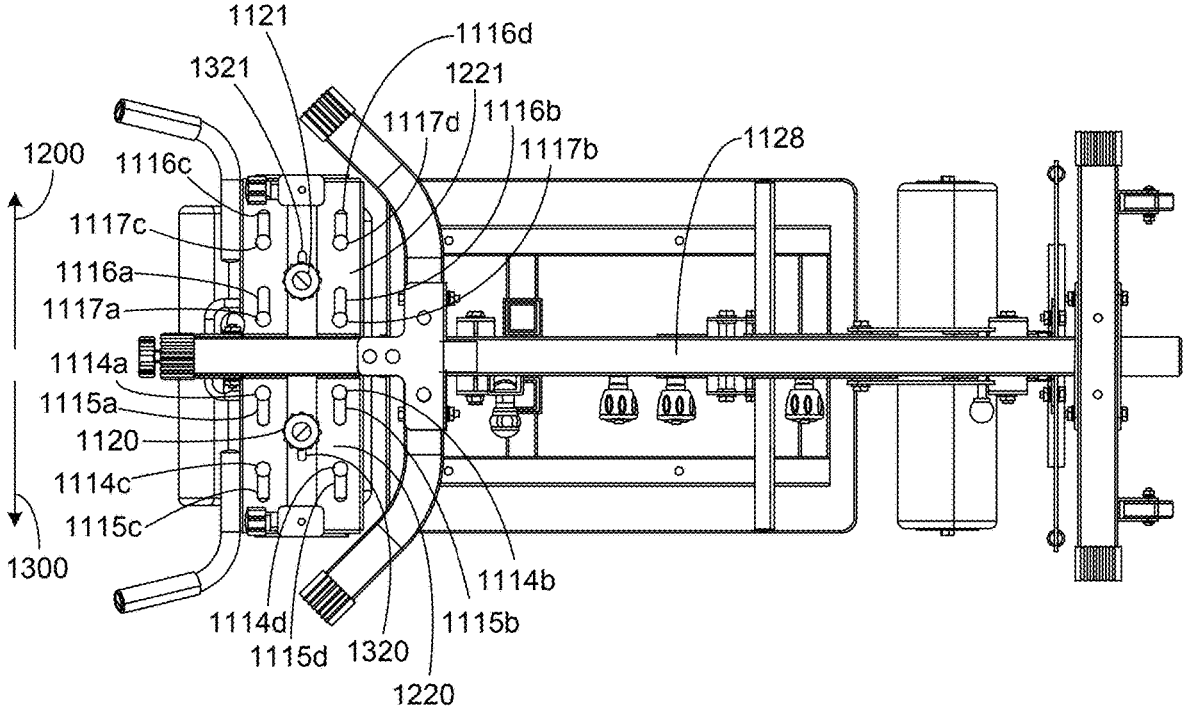
FIG. 17 illustrates a bottom perspective of an embodiment of a multi-configuration exercise device with a slide adjustable second pad and third pad.

The second pad 110 and third pad 111 (shown in FIG. 7) of the device 100 may be coupled to the interface frame 116 at approximately the same position with respect to the longitudinal axis 168 of the interface frame 116 (as shown by the second pad 110 position in FIG. 5). Some embodiments of the device 100 may include a space 290 between the second pad 110 and the third pad 111, as shown in FIGS. 7, 12 and 13. The space 290 between the pads 110, 111 may be useful in accommodating the anatomical features of a user. The width of space 290 may be about 3 cm to about 10 cm; about 4 cm to about 8 cm; about 5 cm to about 7 cm; etc. Some embodiments may include a fourth pad 316. The fourth pad 316 is removably couplable to a plurality of positions with respect to the longitudinal axis 168 of the interface frame 116 upon, for example, the first pad 108, the second pad 110, and/or the third pad 111. The fourth pad 316 may, for example, utilize a hook and loop fastener, magnets, buttons, snaps, or any other removable coupling known in the art, for coupling to the first pad 108 (as shown in FIG. 13), the second pad 110, and/or the third pad 111. The fourth pad 316 may be semi-cylindrical with a flat portion to abut flush with a pad, or pads, (e.g., first pad 108, second pad 110, third pad 111) to which it may couple. The fourth pad 316 may include a slot 394 to accommodate anatomical features of a user. The fourth pad 316 may be coupled to the device 100 to increase comfort during exercises described herein. The width 291 of the slot 314 may be approximately equal to the space 290 between the second pad 110 and the third pad 111. Such that, if the fourth pad 316 is coupled to the second pad 110 and third pad 111 (as shown in FIG. 12), the slot 314 may align with the space 290 between the second pad 110 and the third pad 111. The width 291 of the slot 314 may be about 3 cm to about 10 cm; about 4 cm to about 8 cm; about 5 cm to about 7 cm; etc. Some embodiments may include a fifth pad 320 removably couplable to the interface frame 116 between the second pad 110 and the third pad 111 (shown in FIG. 13). For some exercises it may be more comfortable for the fifth pad 320 to be coupled to the interface frame between the second pad 110 and the third pad 111. The width of the fifth pad 320 may be approximately equal to the width of the space 290 (e.g., about 5% less). The fifth pad 320 may removably coupled to the interface frame 116 using a hook and loop fastener, magnets, buttons, snaps, or any other removable coupling known in the art. The fifth pad 320 may be coupled to the device 100 to increase comfort during exercises described herein. Alternatively, or additionally, some embodiments may include operatively coupling the second pad 110 and the third pad 111 to the interface frame 116 such that the second pad 110 and the third pad 111 are fixed with respect to the longitudinal axis 168 of the interface frame 116 (shown in FIG. 5) but may include slide adjustment approximately perpendicular to the longitudinal axis 168 (with axis 168 being approximately parallel to the horizontal axis 296) of the interface frame 116 and approximately parallel to the normal axis 292 (i.e., the normal axis, the vertical axis 294, and horizontal axis 296 all being perpendicular to one another). Operatively coupling the second pad 110 and the third pad 111 to the interface frame 116 in this way allows the pads 110, 111 to be slide together or apart from one another, thus achieving the space 290 (shown in FIG. 7) between or providing uninterrupted support. For example, one embodiment, shown in FIG. 17, utilizes slot interfaces for the second pad 110 and third pad 111 (shown in FIG. 7) to slide together and apart. The embodiment includes a first plate 1220 and a second plate 1221. The first plate 1220 being coupled to the interface frame 116 and the second plate 1221 being coupled to the interface frame 116. The first plate 1220 may include a plurality of slots 1115, for example, a first slot 1115*a*, a second slot 1115*b*, a third slot 1115*c*, and a fourth slot 1115*d*. The second plate 1221 may include a plurality of slots 1116, for example, a first slot 1116*a*, a second slot 1116*b*, a third slot 1116*c*, and a fourth slot 1116*d*. The second pad 110 may include a plurality of studs 1114, for example, a first stud 1114*a*, a second stud 1114*b*, a third stud 1114*c*, and fourth stud 1114*d*. The second pad 110 may interface with the first plate 1220 with the plurality of studs 1114, for example, the first stud 1114*a* may interface with the first slot 1115*a*, the second stud 1114*b* may interface with the second slot 1115*b*, the third stud 1114*c* may interface with the third slot 1115*c*, and the fourth stud 1114*d* may interface with fourth slot 1115*d*. As such, the orientation of the second pad 110 may be maintained with respect to the interface frame 116, while slide adjustment toward and away from the third pad 111 may be made along directional arrow 1200 (i.e., toward the third pad 111) and directional arrow 1300 (i.e., away from the third pad 111). The second pad 110 may include a frictional lock 1120 operatively coupled to the second pad 110 for locking and unlocking the sliding capability of the second pad 110. The frictional lock 1120 may include a threaded portion coupled to a knob for operation. When loosened and disengaged, the frictional lock 1120 may be free to slide within a fifth slot 1320 of the first plate 1220. When tightened and engaged, the frictional lock 1120 may engage with the first plate 1220 locking the second pad 110 in position. The third pad 111 may include a plurality of studs, for example, a first stud 1117*a*, a second stud 1117*b*, a third stud 1117*c*, and fourth stud 1117*d*. The third pad 111 may interface with the second plate 1221 with the plurality of studs 1117, for example, the first stud 1117*a* may interface with the first slot 1116*a*, the second stud 1117*b* may interface with the second slot 1116*b*, the third stud 1117*c* may interface with the third slot 1115*c*, and the fourth stud 1117*d* may interface with fourth slot 1115*d*. As such, the orientation of the third pad 111 may be maintained with respect to the interface frame 116, while slide adjustment toward and away from the second pad 110 may be made along directional arrow 1200 (i.e., away from the second pad 110) and directional arrow 1300 (i.e., toward the second pad 110). The third pad 111 may include a frictional lock 1121 operatively coupled to the third pad 111 for locking and unlocking the sliding capability of the third pad 111. The frictional lock 1121 may include a threaded portion coupled to a knob for operation. When loosened and disengaged, the frictional lock 1121 may be free to slide within a fifth slot 1321 of the second plate 1221. When tightened and engaged, the frictional lock 1121 may engage with the second plate 1221 locking the third pad 111 in position.

Figure 14A:
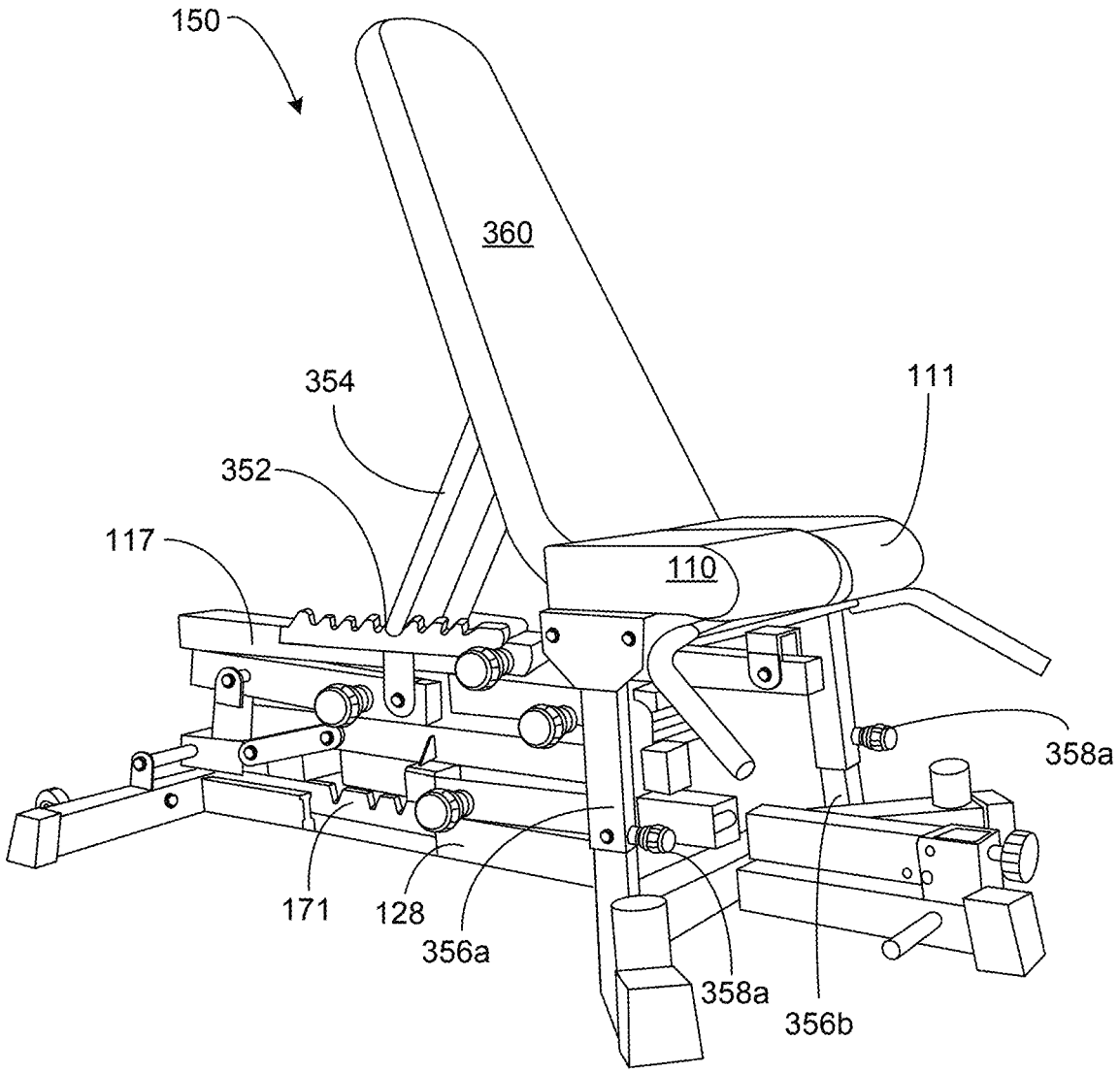
FIG. 14A illustrate an embodiment of a multi-configuration exercise device with an adjustable bench coupled thereto.
Figure 14B:
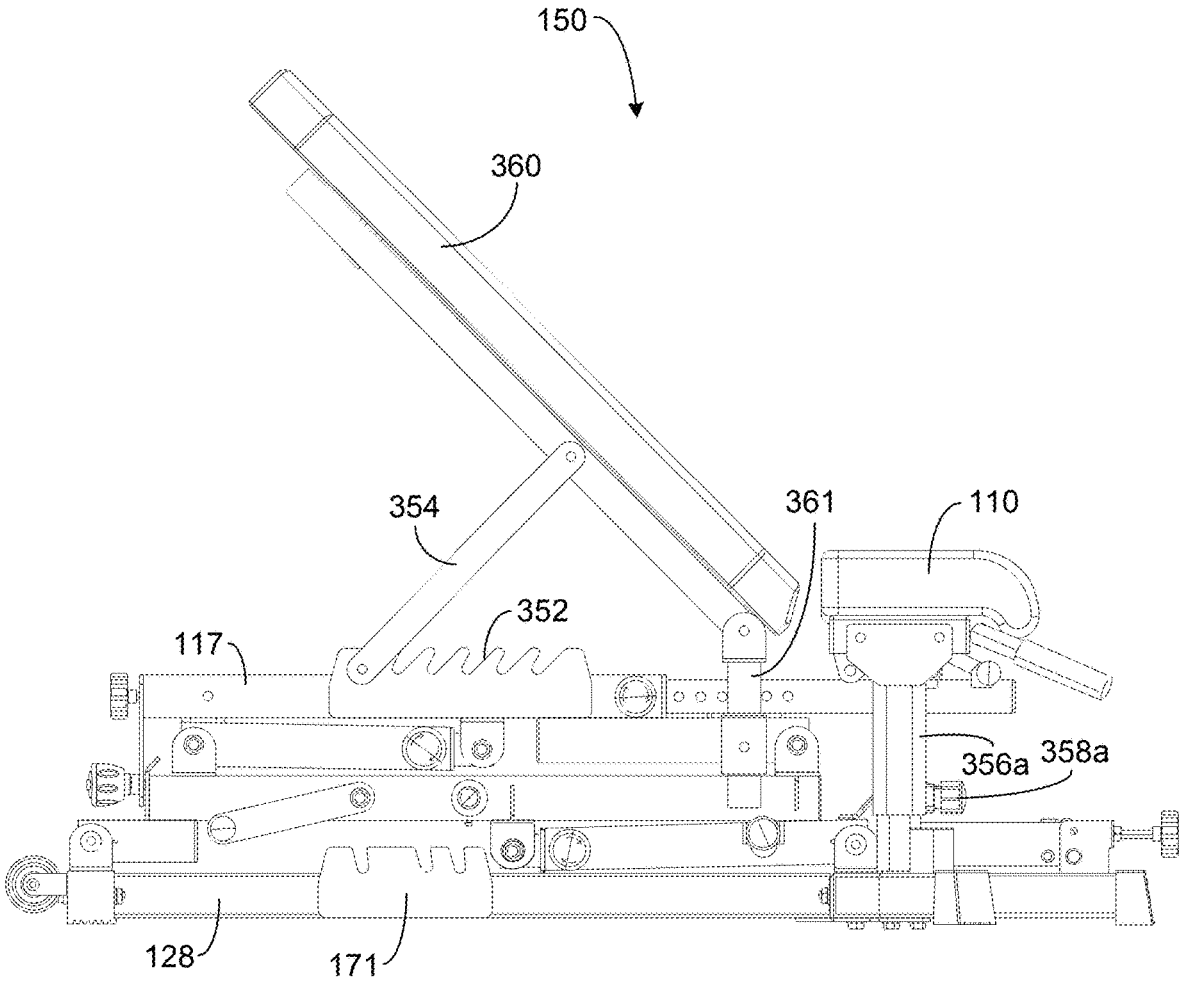
FIG. 14B illustrates another perspective of the multi-configuration exercise device of FIG. 14A with an adjustable bench coupled thereto.
Figure 14C:
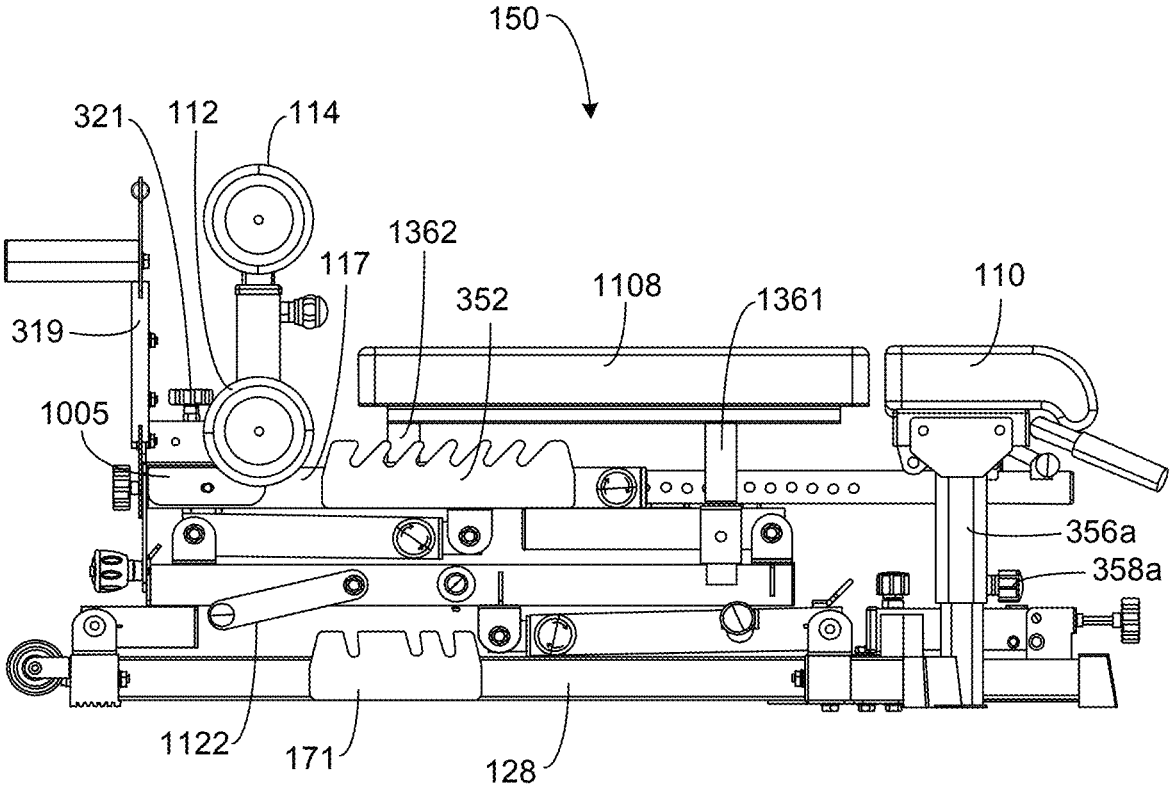
FIG. 14C illustrates of the multi-configuration exercise device capable of FIGS. 14A and 14B with a first pad coupled thereto.

Embodiments of the multi-configuration exercise device may include an adjustable bench 360 that may be coupled to an embodiment of device 150, as shown in FIGS. 14A, 14B, and 14C. In some embodiments, the adjustable bench 360 may be removably coupled to the device 150 when the first pad 1108 (shown in FIG. 14C) is removed. The bench 360 may include a coupling element 361 for coupling the bench 360 to the interface frame 117, such that the bench 360 is hingedly coupled to the interface frame 117. The coupling element 361 may be secured by a releasable pin. Additionally, the bench includes a support brace 354 hingedly coupled to the bench 360. The interface frame 117 may include a unidirectional adjustment interface 352 coupled to the interface frame 117. The unidirectional adjustment interface 352 may include a geometric shape, in which the support brace 354, when engaged with the unidirectional adjustment interface 352, is adjustable in one direction (e.g., a unidirectional saw-tooth pattern). As such, the bench 360 may achieve a plurality of angle adjustments while being angled towards a vertical orientation (i.e., aligned with the vertical axis 294), and prevented from angling back towards a horizontal orientation (i.e., aligned with the horizontal axis 296). The support brace 354 may be removed from engagement with the unidirectional adjustment interface 352 to angle the bench 360 towards a horizontal orientation (i.e., aligned with the horizontal axis 296).

The bench 360 (shown in FIGS. 14A and 14B) and first pad 1108 (shown in FIG. 14C) may secure to the interface frame 117 in the same way. In some embodiments, the first pad 1108 may be rigidly coupled to a respective coupling feature 1361, such that the alignment of the first pad 1108 is fixed with respect to the interface frame 117 when coupled.

Further, the first pad 1108 may include an additional brace 1362 securing the pad 1108 to the interface frame to further support any forces applied to the first pad 1108.

Some embodiments may include a removable base plate 319 (shown in FIG. 14C), and additionally, may include a second cylindrical pad 112 and first cylindrical pad 114 that are removable. The removable base plate 319, removable second cylindrical pad 112 and the removable first cylindrical pad 114 may all be coupled to a removable coupling 1005 for removably coupling to the interface frame 117. The removable coupling 1005 may be pinned to the interface frame 117. When pinning the removable coupling to the interface frame 117, it may be advantageous to include clearance for ease of insertion and removal of one or more coupling pins. As such, slack between the coupling 1005 and the interface frame 117 may occur resulting in non-rigid coupling of the coupling 1005 and the interface frame 117. Some embodiments may include a slack-removal device 321. For example, the slack removal device 321 may include a threaded portion threaded into the coupling 1005, including a knob for operation. When tightened and engaged, the threaded portion is driven into contact with the interface frame 117 forcing the coupling 1005 away from the interface frame 117 and into rigid contact with the one or more pins coupling the coupling 1005 to the interface frame 117, thus removing any slack and ensuring a rigid coupling.

Some embodiments may include support column 356*a*, 356*b* (shown in FIGS. 14A, 14B, and 14C) coupled to the interface frame 117 that may be used to further brace the device 150 (e.g., during exercises utilizing the adjustable bench 360). Columns 356*a*, 356*b* may include length adjustment and may be used to support interface frame 116 upon, for example, a surface the device 150 is resting upon, or the base frame 128 (e.g., the first portion 303, as shown in FIG. 10).

Figure 19:
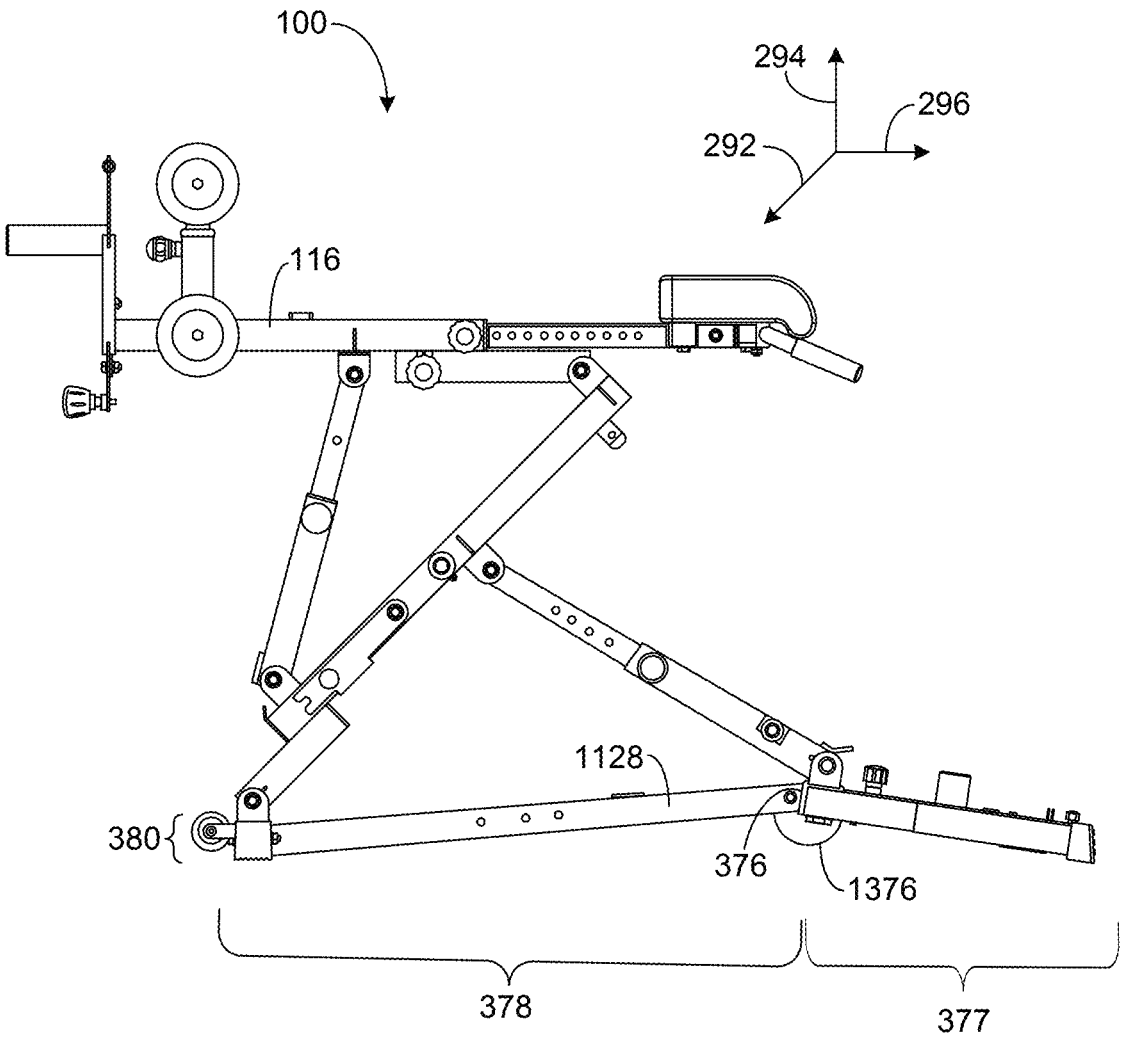
FIG. 19 illustrates a perspective view of an embodiment of a multi-configuration exercise device with a camber-profile base frame.

As shown in FIGS. 8 and 10, embodiments of the multi-configuration exercise device may include one or more cleats coupled to the interface frame 128. Cleats may be composed of materials which include proper strength and friction coefficients. Cleats may be used to stabilize (e.g., avoid tipping, or sliding) the device 100 when the device 100 rests upon the cleat. For example, cleats may be composed of plastic (e.g., polyvinyl chloride, polyurethane, polyethylene, polypropylene, polycarbonate, etc.), rubber (e.g., nitrile butadiene rubber, or other rubber variants), foam, cork, neoprene, or any other appropriate material known in the art. FIG. 10 illustrates a first cleat 315*a*, a second cleat 315*b*, a third cleat 315*c*, and a fourth cleat 315*d*. When the device 100 is laid upon a surface (e.g., the plane defined by the horizontal axis 296 and the normal axis 292), such that the longitudinal axis 160 (shown in FIGS. 2-5) of the base frame 128 is approximately parallel to the surface, and with gravity acting approximately normal to the surface, the cleats 315*a*, 315*b*, 315*c*, 315*d* may be used to stabilize (e.g., avoid tipping, or sliding) the device 100. As shown in FIG. 8, the cleats 315*a*, 315*b*, 315*c* (shown in FIG. 10), 315*d* (shown in FIG. 10) may extend past the bottom surface 129 of the base frame 128 by a dimension 317. With the cleats 315*a*, 315*b*, 315*c*, 315*d* positioned at the outermost points of the base frame 128 (as shown in FIG. 10) the weight of the device 100 may be concentrated on the cleats. As such, stability may be increased for embodiments utilizing cleats. Friction force potentials generated by the cleats 315*a*, 315*b*, 315*c*, 315*d* may be increased as well as the normal force is increased by the weight concentration. Dimension 317 may be about 0.625 cm to about 2 cm; about 0.75 cm to about 1.75 cm; about 1 cm to about 1.5 cm; etc. Alternatively, or additionally, the base frame 1128, as shown in FIG. 19, may include a camber profile (i.e., raised away from the surface the device 100 rests upon near the center creating outermost contact points). For example, the first portion 377 (shown in FIG. 15) of base frame may be angled with respect to the second portion 378 (shown in FIG. 15) of the base frame, such that the point 376 at which the first portion 377 and the second portion 378 meet is at a greater height 380 than the rest of the base frame 1128. For example, the angle 1376 between the first portion 377 (shown in FIG. 15) of the base frame and the second portion 378 (shown in FIG. 15) of the base frame may be about 145 degrees to about 179 degrees; about 155 degrees to about 175 degrees; about 165 degrees to about 170 degrees; etc. When viewed from a perspective normal to the horizontal axis 296 and the vertical axis 294, it can be appreciated that the weight of the device 100 is shifted towards the outermost points of the base frame 1128 (e.g., the positions of the cleats 315*a*, 315*b*, 315*c*, 315*d* in FIG. 10) to increase stability.

The multi-configuration exercise devices described herein include construction with materials with appropriate physical properties and mechanical properties. For example, the interface frame, the support beam, the first strut, and the second strut may be composed of materials with the appropriate hardness and strength, for example, alloys (e.g., low-carbon steel, high-carbon steels, mild-carbon steel, stainless steel, aluminum, galvanized steel, etc.), composites, or any other appropriate materials known in the art. For example, pads described herein may be composed in part or solely of appropriate padding material, for example, polyvinyl chloride, thermoplastic elastomer, nitrile butadiene rubber, other rubber variants, foam, cork, neoprene, canvas, or any other appropriate materials known in the art. The interface frames, the support beam, the base frame, the first strut, and the second strut described herein include a composition of material with appropriate mechanical performance, for example, rigidity, tensile strength, compressive strength, etc. For example, the interface frames, the support beam, the base frame, the first strut, and the second strut may be constructed of square tubing with an outer diameter of about 2.5 cm to about 10.0 cm; about 3.0 cm to about 7.5 cm; about 4 cm to about 6 cm; etc.

As used herein, "coupling feature" may include, but not be limited to: a unidirectional saw-tooth pattern, extruded studs, defined apertures, a unidirectional geometrically shaped interface, one or more telescoping tubes, or a combination of the aforementioned.

As used herein, "coupling" may include, but not be limited to: a bracket and axle, a hinge, a pivot, a joint, a swivel, or a fulcrum.

Terms such as first, second, third, fourth, fifth, etc. are used herein but are not used to indicate a sequence or order but rather to distinguish like features or similar components from one another.

As used in the description and claims, the singular form "a", "an" and "the" include both singular and plural references unless the context clearly dictates otherwise. For example, the term "sensor" may include, and is contemplated to include a plurality of sensors. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, substance, or composition.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

EXAMPLE EMBODIMENTS

Example 1. An exercise device, comprising: a base frame; an interface frame; a support beam hingedly coupled to the base frame and hingedly coupled the interface frame; a first strut hingedly coupled to the first strut and the interface frame, wherein the first strut comprises an adjustable length; and a second strut hingedly coupled to the first strut and the base frame, wherein the second strut comprises an adjustable length, and wherein adjusting the length of the first strut and the length of the second strut manipulates a height of the interface frame with respect to the base frame and manipulates an orientation of the interface frame with respect to the base frame.

Example 2. The exercise device of any one of the preceding examples, but particularly example 1, further comprising an auxiliary support beam hingedly coupled to the support beam, wherein the base frame comprises a plurality of coupling features at predetermined positions with respect to a longitudinal axis of the base frame.

Example 3. The exercise device of any one of the preceding examples, but particularly example 1, further comprising an auxiliary support beam hingedly coupled to the base frame, wherein the support beam comprises a plurality of coupling features at predetermined positions with respect to a longitudinal axis of the support beam.

Example 4. The exercise device of any one of the preceding examples, but particularly example 1, wherein a length of the interface frame is adjustable.

Example 5. The exercise device of any one of the preceding examples, but particularly example 1, further comprising a storage configuration, wherein the height of the interface frame is minimized with respect to the base frame, wherein a longitudinal axis of the interface frame, a longitudinal axis of the base frame, and a vertical axis are approximately parallel.

Example 6. The exercise device of any one of the preceding examples, but particularly example 5, wherein, in the storage configuration, the longitudinal axis of the first strut, the longitudinal axis of the second strut, and the longitudinal axis of the support beam are approximately parallel to one another and the vertical axis.

Example 7. The exercise device of any one of the preceding examples, but particularly example 1, wherein the interface frame further comprises a plurality of pads.

Example 8. The exercise device of any one of the preceding examples, but particularly example 7, wherein the interface frame further comprises a first cylindrical pad and a second cylindrical pad, wherein the second cylindrical pad is removably coupled to the interface frame, wherein a dimension between the first cylindrical pad and the second cylindrical pad is adjustable.

Example 9. The exercise device of any one of the preceding examples, but particularly example 8, further comprising a post hingedly coupled to the base frame, wherein: the post comprises a first fixable configuration and a second fixable configuration; in the first fixable configuration, the longitudinal axis of the post is approximately parallel to the longitudinal axis of the base frame; in the second fixable configuration, the longitudinal axis of the post is approximately perpendicular to the longitudinal axis of the base frame and approximately parallel to a vertical axis; and in the second fixable configuration, the first cylindrical pad is removably coupled to the post.

Example 10. The exercise device of any one of the preceding examples, but particularly example 7, wherein the interface frame further comprises a first pad, a second pad, and a third pad, wherein the first pad is removably coupled to the interface frame.

Example 11. The exercise device of any one of the preceding examples, but particularly example 10, wherein the second pad and the third pad are positioned at approximately at a same position with respect the longitudinal axis of the interface frame, wherein the second pad and third pad comprise a space therebetween.

Example 12. The exercise device of any one of the preceding examples, but particularly example 11, further comprising a fourth pad, wherein the fourth pad is removably couplable to a plurality of positions with respect to the longitudinal axis of the interface frame upon at least one of: the first pad, the second pad, or the third pad.

Example 13. The exercise device of any one of the preceding examples, but particularly example 12, wherein the fourth pad is semi-cylindrical, wherein the fourth pad further comprises a slot comprising a width approximately equal to the width of the space between the second pad and the third pad.

Example 14. The exercise device of any one of the preceding examples, but particularly example 11, further comprising a fifth pad, wherein the fifth pad is removably couplable to the interface frame between the second pad and the third pad.

Example 15. The exercise device of any one of the preceding examples, but particularly example 1, further comprising a base plate coupled to the interface frame.

Example 16. The exercise device of any one of the preceding examples, but particularly example 15, wherein the base plate further comprises one or more horns.

Example 17. The exercise device of any one of the preceding examples, but particularly example 1, further comprising a plurality of handles.

Example 18. The exercise device of any one of the preceding examples, but particularly example 1, further comprising one or more pegs on the support beam.

Example 19. The exercise device of any one of the preceding examples, but particularly example 1, further comprising one or more wheels coupled to the base frame.

Example 20. The exercise device of any one of the preceding examples, but particularly example 1, wherein the base frame comprises one or more portions comprising a width great enough to adequately stabilize the workout device during use.

Example 21. An exercise device, comprising: a base frame; an interface frame; a support beam hingedly coupled to the base frame and hingedly coupled the interface frame; a first strut hingedly coupled to the first strut and the interface frame, wherein the first strut comprises an adjustable length; and a second strut hingedly coupled to the first strut and the base frame, wherein the second strut comprises an adjustable length, wherein increasing the length of the first strut increases a degree amount of a first angle and decreasing the length of the first strut decreases the degree amount of the first angle, and wherein increasing the length of the second strut increases a degree amount of a second angle and decreasing the length of the second strut decreases the degree amount of the second angle.

Example 22. The exercise device of any one of the preceding examples, but particularly example 21, further comprising an auxiliary support beam hingedly coupled to the support beam, wherein the base frame comprises a plurality of coupling features at predetermined positions with respect to a longitudinal axis of the base frame.

Example 23. The exercise device of any one of the preceding examples, but particularly example 21, further comprising an auxiliary support beam hingedly coupled to the base frame, wherein the support beam comprises a plurality of coupling features at predetermined positions with respect to a longitudinal axis of the support beam.

Example 24. The exercise device of any one of the preceding examples, but particularly example 21, wherein a length of the interface frame is adjustable.

Example 25. The exercise device of any one of the preceding examples, but particularly example 21, further comprising a storage configuration, wherein the height of the interface frame is minimized with respect to the base frame, wherein a longitudinal axis of the interface frame, a longitudinal axis of the base frame, and a vertical axis are approximately parallel.

Example 26. The exercise device of any one of the preceding examples, but particularly example 25, wherein, in the storage configuration, the longitudinal axis of the first strut, the longitudinal axis of the second strut, and the longitudinal axis of the support beam are approximately parallel to one another and the vertical axis.

Example 27. The exercise device of any one of the preceding examples, but particularly example 21, wherein the interface frame further comprises a plurality of pads.

Example 28. The exercise device of any one of the preceding examples, but particularly example 27, wherein the interface frame further comprises a first cylindrical pad and a second cylindrical pad, wherein the first cylindrical pad is removably coupled to the interface frame, wherein a dimension between the first cylindrical pad and the second cylindrical pad is adjustable.

Example 29. The exercise device of any one of the preceding examples, but particularly example 28, further comprising a post hingedly coupled to the base frame, wherein: the post comprises a first fixable configuration and a second fixable configuration; in the first fixable configuration, the longitudinal axis of the post is approximately parallel to the longitudinal axis of the base frame; in the second fixable configuration, the longitudinal axis of the post is approximately perpendicular to the longitudinal axis of the base frame and approximately parallel to a vertical axis; and in the second fixable configuration, the second cylindrical pad is removably coupled to the post.

Example 30. The exercise device of any one of the preceding examples, but particularly example 27, wherein the interface frame further comprises a first pad, a second pad, and a third pad, wherein the first pad is removably coupled to the interface frame.

Example 31. The exercise device of any one of the preceding examples, but particularly example 30, wherein the second pad and the third pad are positioned at approximately at a same position with respect the longitudinal axis of the interface frame, wherein the second pad and third pad comprise a space therebetween.

Example 32. The exercise device of any one of the preceding examples, but particularly example 31, further comprising a fourth pad, wherein the fourth pad is removably couplable to a plurality of positions with respect to the longitudinal length of the interface frame upon at least one of: the first pad, the second pad, or the third pad.

Example 33. The exercise device of any one of the preceding examples, but particularly example 32, wherein the fourth pad is semi-cylindrical, wherein the fourth pad further comprises a slot comprising a width approximately equal to the width of the space between the second pad and the third pad.

Example 34. The exercise device of any one of the preceding examples, but particularly example 31, further comprising a fifth pad, wherein the fifth pad is removably couplable to the interface frame between the second pad and the third pad.

Example 35. The exercise device of any one of the preceding examples, but particularly example 21, further comprising a base plate coupled to the interface frame.

Example 36. The exercise device of any one of the preceding examples, but particularly example 35, wherein the base plate further comprises one or more horns.

Example 37. The exercise device of any one of the preceding examples, but particularly example 21, further comprising a plurality of handles.

Example 38. The exercise device of any one of the preceding examples, but particularly example 21, further comprising one or more pegs on the support beam.

Example 39. The exercise device of any one of the preceding examples, but particularly example 21, further comprising one or more wheels coupled to the base frame.

Example 40. The exercise device of any one of the preceding examples, but particularly example 21, wherein the base frame comprises one or more portions comprising a width great enough to adequately stabilize the workout device during use.

Example 41. The exercise device of any one of the preceding examples, wherein the degree amount of the first angle and the degree amount of the second angle are both approximately 0 degrees.

Example 42. The exercise device of any one of the preceding examples, wherein the degree amount of the first angle and the degree amount of the second angle are both approximately equal and wherein the degree amount of the first angle and the degree amount of the second angle are both greater than 0 degrees.

Example 43. The exercise device of any one of the preceding examples, wherein the degree amount of the first angle is greater than the degree amount of the second angle.

Example 44. The exercise device of any one of the preceding examples, wherein the degree amount of the first angle is less than the degree amount of the second angle.

Example 45. An exercise device, comprising: a base frame, wherein a weight of the device is at least one of: shifted toward outermost points of the base frame by the base frame including a camber profile, or concentrated at the outermost points of the base frame with one or more cleats extending beyond a bottom surface of the base frame; an interface frame; a support beam hingedly coupled to the base frame and hingedly coupled the interface frame; a first strut hingedly coupled to the first strut and the interface frame, wherein the first strut comprises an adjustable length; and a second strut hingedly coupled to the first strut and the base frame, wherein the second strut comprises an adjustable length, and wherein adjusting the length of the first strut and the length of the second strut manipulates a height of the interface frame with respect to the base frame and manipulates an orientation of the interface frame with respect to the base frame.

Example 46. The exercise device of any one of the preceding examples, but particularly example 45, further comprising an auxiliary support beam hingedly coupled to the support beam, wherein the base frame comprises a plurality of coupling features at predetermined positions with respect to a longitudinal axis of the base frame.

Example 47. The exercise device of any one of the preceding examples, but particularly example 45, further comprising an auxiliary support beam hingedly coupled to the base frame, wherein the support beam comprises a plurality of coupling features at predetermined positions with respect to a longitudinal axis of the support beam.

Example 48. The exercise device of any one of the preceding examples, but particularly example 45, wherein a length of the interface frame is adjustable.

Example 49. The exercise device of any one of the preceding examples, but particularly example 45, further comprising a storage configuration, wherein the height of the interface frame is minimized with respect to the base frame, wherein a longitudinal axis of the interface frame, a longitudinal axis of the base frame, and a vertical axis are approximately parallel.

Example 50. The exercise device of any one of the preceding examples, but particularly example 49, wherein, in the storage configuration, the longitudinal axis of the first strut, the longitudinal axis of the second strut, and the longitudinal axis of the support beam are approximately parallel to one another and the vertical axis.

Example 51. The exercise device of any one of the preceding examples, but particularly example 45, wherein the interface frame further comprises a plurality of pads.

Example 52. The exercise device of any one of the preceding examples, but particularly example 51, wherein the interface frame further comprises a first cylindrical pad and a second cylindrical pad, wherein the first cylindrical pad is removably coupled to the interface frame, wherein a dimension between the first cylindrical pad and the second cylindrical pad is adjustable.

Example 53. The exercise device of any one of the preceding examples, but particularly example 52, further comprising a post hingedly coupled to the base frame, wherein: the post comprises a first fixable configuration and a second fixable configuration; in the first fixable configuration, the longitudinal axis of the post is approximately parallel to the longitudinal axis of the base frame; in the second fixable configuration, the longitudinal axis of the post is approximately perpendicular to the longitudinal axis of the base frame and approximately parallel to a vertical axis; and in the second fixable configuration, the second cylindrical pad is removably coupled to the post.

Example 54. The exercise device of any one of the preceding examples, but particularly example 51, wherein the interface frame further comprises a first pad, a second pad, and a third pad, wherein the first pad is removably coupled to the interface frame.

Example 55. The exercise device of any one of the preceding examples, but particularly example 54, wherein the second pad and the third pad are positioned at approximately at a same position with respect the longitudinal axis of the interface frame, wherein the second pad and third pad comprise a space therebetween.

Example 56. The exercise device of any one of the preceding examples, but particularly example 55, further comprising a fourth pad, wherein the fourth pad is removably couplable to a plurality of positions with respect to the longitudinal axis of the interface frame upon at least one of: the first pad, the second pad, or the third pad.

Example 57. The exercise device of any one of the preceding examples, but particularly example 56, wherein the fourth pad is semi-cylindrical, wherein the fourth pad further comprises a slot comprising a width approximately equal to the width of the space between the second pad and the third pad.

Example 58. The exercise device of any one of the preceding examples, but particularly example 55, further comprising a fifth pad, wherein the fifth pad is removably couplable to the interface frame between the second pad and the third pad.

Example 59. The exercise device of any one of the preceding examples, but particularly example 45, further comprising a base plate coupled to the interface frame.

Example 60. The exercise device of any one of the preceding examples, but particularly example 59, wherein the base plate further comprises one or more horns.

Example 61. The exercise device of any one of the preceding examples, but particularly example 45, further comprising a plurality of handles.

Example 62. The exercise device of any one of the preceding examples, but particularly example 45, further comprising one or more pegs on the support beam.

Example 63. The exercise device of any one of the preceding examples, but particularly example 45, further comprising one or more wheels coupled to the base frame.

Example 64. The exercise device of any one of the preceding examples, but particularly example 45, wherein the base frame comprises one or more portions comprising a width great enough to adequately stabilize the workout device during use.

Example 65. An exercise device, comprising: a base frame; an interface frame; a first cylindrical pad, wherein the interface frame is manipulatable in one or more of: height and orientation, with respect to the base frame, wherein, in a first configuration, the first cylindrical pad is removably coupled to the interface frame, and wherein, in a second configuration, the first cylindrical pad is removably coupled to the base frame.

Example 66. The exercise device of any one of the preceding examples, but particularly example 65, further comprising a second cylindrical pad coupled to the interface frame.

Example 67. The exercise device of any one of the preceding examples, but particularly example 66, wherein a dimension between the first cylindrical pad and the second cylindrical pad is adjustable Example 68. The exercise device of any one of the preceding examples, but particularly example 65, wherein, in the second configuration, the first cylindrical pad is coupled to a first portion of the base frame.

Example 69. The exercise device of any one of the preceding examples, but particularly example 65, wherein, in the second configuration, the height of the first cylindrical pad is adjustable.

What is claimed is:

1. A method of adjusting a multi-configuration exercise device, comprising:

adjusting a length of a first strut coupled to a support beam and an interface frame to adjust a first angle between the interface frame and the support beam; and adjusting a length of a second strut coupled to the support beam and a base frame to adjust a second angle between the support beam and the base frame, wherein adjusting the first angle and the second angle manipulates a height and an orientation of the interface frame with respect to the base frame, wherein the second angle is adjusted to be less than the first angle such that the interface frame and the base frame define a decline angle that is about 0 degrees to about 60 degrees.

2. The method of claim 1, wherein the second angle is also adjusted utilizing an auxiliary support beam coupled to the support beam or the base frame.

3. The method of claim 2, wherein the auxiliary support beam engages to one or more coupling features of the base frame.

4. The method of claim 3, wherein each of the one or more coupling features indicates a number of degrees of the second angle.

5. The method of claim 1, wherein the decline angle is about 0 degrees to about 45 degrees.

6. The method of claim 1, wherein the decline angle is a differential between the second angle and the first angle.

7. The method of claim 1, wherein the length of the first strut pitches the interface frame about a coupling between the interface frame and the support beam.

8. The method of claim 1, wherein the length of the second strut pitches the support beam about a coupling between the support beam and the base frame.

9. A method of adjusting a multi-configuration exercise device, comprising:

adjusting a length of a first strut coupled to a support beam and an interface frame to adjust a first angle between the interface frame and the support beam; and adjusting a second angle between the support beam and a base frame with at least one of: an auxiliary support beam coupled to the support beam or the base frame, or a second strut with an adjustable length coupled to the support beam and the base frame, wherein the second angle is adjusted to be less than the first angle such that the interface frame and the base frame define a decline angle, and locks the interface frame to prevent angling back toward a horizontal orientation, and wherein adjusting the first angle and the second angle manipulates a height and an orientation of the interface frame with respect to the base frame.

10. The method of claim 9, wherein the decline angle is about 0 degrees to about 90 degrees.

11. The method of claim 9, wherein the decline angle is about 0 degrees to about 60 degrees.

12. The method of claim 9, wherein the decline angle is about 0 degrees to about 45 degrees.

13. The method of claim 9, wherein the length of the first strut pitches the interface frame about a coupling between the interface frame and the support beam.

14. The method of claim 9, wherein the adjustable length of the second strut pitches the support beam about a coupling between the support beam and the base frame.

15. A method of adjusting a multi-configuration exercise device, comprising:

adjusting a length of a first strut coupled to a support beam and an interface frame to adjust a first angle between the interface frame and the support beam; and adjusting a length of a second strut coupled to the support beam and a base frame to adjust a second angle between the support beam and the base frame, wherein the second angle is adjusted to be less than the first angle such that the interface frame and the base frame define a decline angle, and locks the interface frame to prevent angling back toward a horizontal orientation, and wherein adjusting the first angle and the second angle is configured to manipulate a height and an orientation of the interface frame with respect to the base frame.

16. The method of claim 15, wherein the decline angle is about 0 degrees to about 90 degrees.

17. The method of claim 15, wherein the decline angle is about 0 degrees to about 60 degrees.

18. The method of claim 15, wherein the decline angle is about 0 degrees to about 45 degrees.

19. The method of claim 15, wherein the length of the first strut pitches the interface frame about a coupling between the interface frame and the support beam.

20. The method of claim 15, wherein the length of the second strut pitches the support beam about a coupling between the support beam and the base frame.

* * * * *